US009401569B2

(12) United States Patent
Davis et al.

(10) Patent No.: US 9,401,569 B2
(45) Date of Patent: Jul. 26, 2016

(54) ELECTRICAL CONNECTOR ASSEMBLY HAVING SIGNAL MODULES AND GROUND SHIELDS

(71) Applicant: Tyco Electronics Corporation, Berwyn, PA (US)

(72) Inventors: Wayne Samuel Davis, Harrisburg, PA (US); Michael James Horning, Lancaster, PA (US); John Joseph Consoli, Harrisburg, PA (US); Thomas Edward Messenger, Palmyra, PA (US); Andrew Michael Homick, Camp Hill, PA (US); Daniel Briner Shreffler, Mechanicsburg, PA (US); Chad W. Morgan, Carneys Point, NJ (US); Raymond D. Boyer, Mechanicsburg, PA (US); Vincent Ruminski, Camp Hill, PA (US); Masayuki Aizawa, Tokyo (JP); Edward Lee Hengst, Glen Rock, PA (US)

(73) Assignees: TYCO ELECTRONICS CORPORATION, Berwyn, PA (US); TYCO ELECTRONICS JAPAN G.K., Kanagawa (JP)

( * ) Notice: Subject to any disclaimer, the term of this patent is extended or adjusted under 35 U.S.C. 154(b) by 23 days.

(21) Appl. No.: 14/507,231

(22) Filed: Oct. 6, 2014

(65) Prior Publication Data

US 2016/0099532 A1 Apr. 7, 2016

(51) Int. Cl.
*H01R 13/648* (2006.01)
*H01R 13/6585* (2011.01)

(52) U.S. Cl.
CPC ..... *H01R 13/6585* (2013.01)

(58) Field of Classification Search
CPC ..... H01R 23/7073; H01R 4/64; H01R 4/646; H01R 23/688; H01R 13/65802
USPC ..... 439/79, 92, 98, 101, 108, 607.01, 439/607.05, 607.07, 660
See application file for complete search history.

(56) References Cited

U.S. PATENT DOCUMENTS 4,975,069 A * 12/1990 Fedder ..... H01R 12/775 439/101
4,976,628 A * 12/1990 Fedder ..... H01R 9/032 439/101
6,227,882 B1 * 5/2001 Ortega ..... H01R 23/688 439/101
6,364,710 B1 * 4/2002 Billman ..... H01R 13/2414 439/101
6,575,774 B2 * 6/2003 Ling ..... H01R 13/53 439/101
6,910,922 B2 * 6/2005 Haga ..... H01R 13/65807 439/101
6,923,664 B2 * 8/2005 Ito ..... H01R 13/6585 439/108
7,670,154 B2 * 3/2010 Yu ..... H01R 4/184 439/579
7,690,946 B2 4/2010 Knaub
7,819,675 B2 * 10/2010 Ko ..... H01R 9/034 439/98
7,931,500 B2 4/2011 Knaub et al.
7,976,340 B1 7/2011 Saraswat et al.
8,430,691 B2 4/2013 Davis
8,469,745 B2 6/2013 Davis et al.
8,475,209 B1 * 7/2013 Whiteman, Jr. ..... H01R 12/724 439/607.07

(Continued)

*Primary Examiner* — Thanh Tam Le

(57) ABSTRACT

A header assembly of a mezzanine connector system may include a main housing defining signal channels extending through the main housing and ground channels extending into a first surface of the main housing, a plurality of signal modules, and a plurality of ground shields. At least a portion of each of the plurality of signal modules is retained within a respective one of the signal channels. At least a portion of each of the plurality of ground shields is retained within at least one of the ground channels.

19 Claims, 15 Drawing Sheets

(56) References Cited

U.S. PATENT DOCUMENTS 8,591,260 B2 11/2013 Davis et al.
8,845,365 B2 * 9/2014 Schroll ..... H01R 9/034 439/607.27
8,905,767 B2 * 12/2014 Putt, Jr. ..... H01R 13/652 439/101
8,961,229 B2 * 2/2015 Pan ..... H01R 13/6474 439/607.07
8,961,235 B2 * 2/2015 Little ..... H01R 13/64 439/374
9,166,343 B1 * 10/2015 Jeon ..... H01R 13/6587
2014/0017950 A1 1/2014 Peloza

* cited by examiner

ELECTRICAL CONNECTOR ASSEMBLY HAVING SIGNAL MODULES AND GROUND SHIELDS

BACKGROUND OF THE DISCLOSURE

Embodiments of the present disclosure generally relate to electrical connector systems, such as mezzanine connector systems, and, more particularly, to component assemblies, such as header assemblies, of mezzanine connector systems.

Known mezzanine connector systems mechanically and electrically interconnect a pair of circuit boards in a parallel arrangement. A typical mezzanine connector system engages both circuit boards to interconnect the circuit boards to one another. For example, the mezzanine connector system mounts to one of the circuit boards and engages the other circuit board at a separable mating interface. The mezzanine connector system typically uses deflectable spring beams at the separable mating interface. However, such interfaces utilize a significant amount of space because the spring beams typically have long beam lengths to achieve adequate spring force and deformation range. Contact density of such mezzanine connector systems is typically limited because of the separable mating interface. At least some known mezzanine connector systems utilize two mezzanine connectors, each mounted to a different circuit board and then mated together. Such systems can be complex and difficult to manufacture. For example, such mezzanine connector systems have many contacts individually loaded into a housing, which may be difficult and time consuming to assemble. Further, known mezzanine connector systems suffer from signal performance limits due to tight spacing of the contacts therein.

Thus, a need exists for a mezzanine connector system that provides a cost effective and reliable connection between circuit boards.

BRIEF DESCRIPTION OF THE DISCLOSURE

Certain embodiments of the present disclosure provide a component assembly, such as a header assembly, of an electrical connector system, such as a mezzanine connector system. The header assembly may include a main housing defining signal channels extending through the main housing and ground channels extending into a first surface of the main housing, a plurality of signal modules, and a plurality of ground shields. At least a portion of each of the plurality of signal modules is retained within a respective one of the signal channels. At least a portion of each of the plurality of ground shields is retained within at least one of the ground channels.

The main housing may be formed as a unitary piece. For example, the main housing may be formed as a single piece of molded or die cast metal. Alternatively, the main housing be formed from separate and distinct component pieces.

The header assembly may also include a mating shroud secured to the main housing. The mating shroud is configured to receive a receptacle assembly. The mating shroud may include one or more latch members that latchably secure to one or more reciprocal latch retainers of the main housing. The mating shroud may include a base integrally connected to a perimeter wall extending from the base. An internal chamber is defined between the base and the perimeter wall. The receptacle assembly is configured to mate to the header assembly within the internal chamber.

In at least one embodiment, the main housing is formed of metal and the mating shroud is formed of plastic. In at least one embodiment, the main housing includes a plastic inner body that is plated with a metal.

Each of the signal channels may have opposed first and second sides connected to opposed first and second ends at the first surface of the main housing. The plurality of ground channels may include a first ground channel disposed outside of the first side, a second ground channel disposed outside of the second side, a third ground channel disposed outside of the first end, and a fourth ground channel disposed outside of the second end. As such, each signal channel may be bounded by ground channels at and/or proximate to the first surface.

Each of the plurality of signal modules may include a carrier that retains header signal pins. The carrier may include one or more retention protuberances extending outwardly therefrom. The retention protuberance(s) securely connect the carrier to the main housing within one of the signal channels. In at least one embodiment, the carrier may include one or more shoulders configured to abut against ledges of the main housing.

At least one of the plurality of ground shields may include a C-shaped ground shield. The C-shaped ground shield may include a main beam connected to opposed first and second end beams. Alternatively, the ground shields may be other than C-shaped ground shields. For example, one or more of the ground shields may be round, rectangular, elliptical, or the like. The main beam resides in a first plane that may be orthogonal to second and third planes in which the first and second end beams reside. Each of the plurality of ground shields may include a resilient securing tab extending from a main beam. The resilient securing tab securely latches the main beam to a portion of the header assembly. Each of the plurality of ground shields may include at least one outwardly-extending retention protuberance that securely retains each of the plurality of ground shields in a respective one of the ground channels. In at least one embodiment, at least one of the plurality of ground shields may include a single planar beam.

Each of the plurality of ground shields may be oriented in a common direction. Alternatively, neighboring ground shields (that is, those ground shields that are closest to one another) may be oriented in opposite directions. For example, the ground shields may be alternate orientations by column or row.

The header assembly may also include a header ground contact extending from a second surface of the main housing. The second surface may be opposite from the first surface.

Each of the plurality of signal modules may be surrounded or bounded by ground material throughout the header assembly. For example, each portion of the signal module within the main housing may be bounded or otherwise surrounded by conductive ground material that defines the signal channel within the main housing. Portions of the signal modules that extend past the first surface of the main housing may be bounded or otherwise surrounded by one or more ground shields, while portions of the signal modules that extend past a second surface that is opposite from the first surface may be bounded or otherwise surrounded by one or more header ground contacts.

DETAILED DESCRIPTION OF THE DISCLOSURE

Embodiments of the present disclosure provide an electrical connector system, such as a mezzanine connector system, including a component assembly, such as a header assembly, that may be formed as a unitary piece. The header assembly may include a first set of channels (for example, signal channels) configured to receive and retain signal contacts, such as signal pins retained within a dielectric carrier, and a second set of channels (for example, ground channels) that are configured to receive and retain ground shields.

Embodiments of the present disclosure provide a header assembly including a main housing that defines signal channels and separate and distinct ground channels. Instead of channels that receive modules or inserts having both signal and ground contacts, embodiments of the present disclosure provide a header assembly having separate and distinct signal and ground channels.

As described below, signal modules may be bounded or otherwise surrounded by material within and throughout a header assembly. The material may include internal structural portions of a main housing that define signal channels, such as internal signal passages, tunnels, or the like that are configured to receive signal modules. The material may also include one or more ground shields extending from a first surface of the main housing, and ground contacts extending from a second surface of the main housing that is opposite the first surface. The material bounds each signal channel in that the material is disposed in relation to each outer perimeter portion of an axial cross section of the signal channel that retains a signal module. The material may or may not directly touch a portion of the signal channel or signal module. Further, the bounding may or may not be contiguous. For example, orthogonal ground channels may be separated by gaps. In bounding the signal module, another signal module may not be disposed between the material and the signal module.

Figure 1:
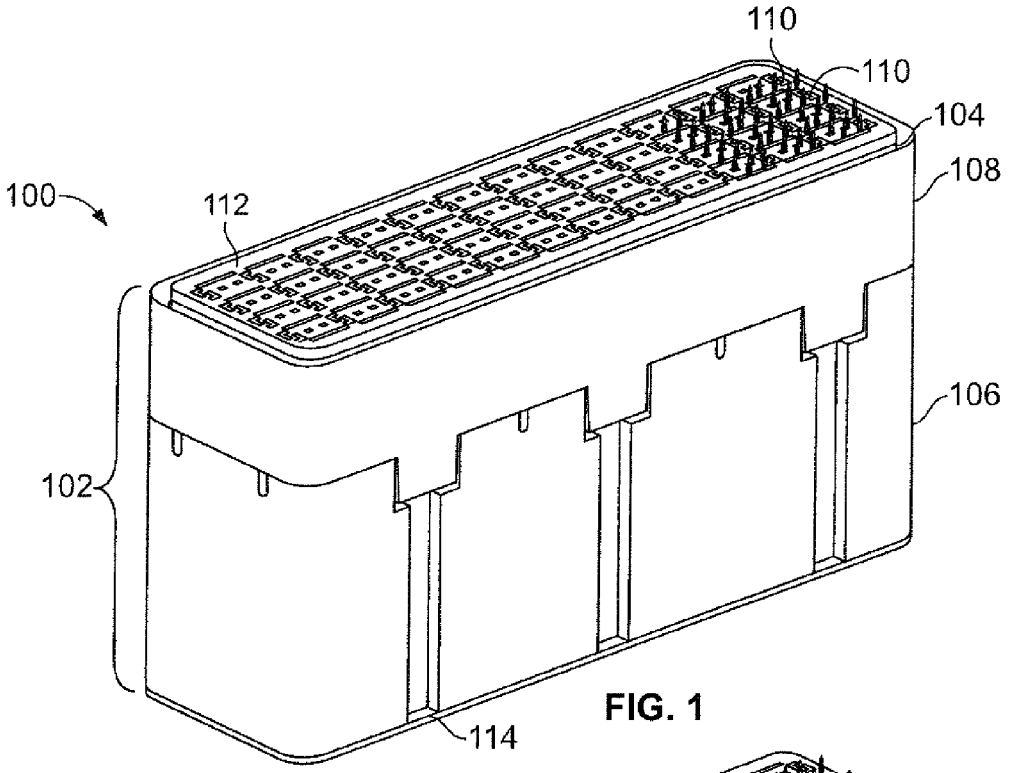
FIG. 1 illustrates a perspective top view of a mezzanine connector system, according to an embodiment of the present disclosure.

FIG. 1 illustrates a perspective top view of a mezzanine connector system 100, according to an embodiment of the present disclosure. The mezzanine connector system 100 may include a component assembly, such as a header assembly 102, that mates with a receptacle assembly 104. The header assembly 102 may include a unitary main housing 106 secured to a mating shroud 108.

The main housing 106 may be integrally molded and formed as a single piece. For example, the main housing 106 may be a single piece of injection-molded or die cast conductive metal. The main housing 106 provides a ground housing for the mezzanine connector system 100. The structure of the main housing 106 provides a ground path.

The mating shroud 108 may also be integrally molded and formed as a single piece. For example, the mating shroud 108 may be a single piece of injection-molded or die cast nonconductive metal. The mating shroud 108 may removably connect to the main housing 106, such as through a latchable or snapable engagement.

Alternatively, the main housing 106 and the mating shroud 108 may be integrally molded and formed as a single piece. For example, the mating shroud 108 and the main housing 106 may be integrally molded and formed together as a single piece, such as a single piece of injection-molded or die cast conductive metal. Optionally, the mating shroud 108 may be formed of plastic and overmolded onto the metal main housing 106.

The receptacle assembly 104 is configured to mate with the header assembly 102 by being urged into a mating chamber defined by the mating shroud 108. A plurality of contacts 110, including signal and ground contacts, extend upwardly from a top surface of the receptacle assembly 104 and are configured to mate with reciprocal features of a first circuit board (not shown in FIG. 1). The receptacle assembly 104 may be separated from a bottom surface of the first circuit board by a spacer 112. The spacer 112 may be configured to position and align ground contacts, for example.

Similarly, contacts (hidden from view in FIG. 1) extend downwardly from a bottom surface of the header assembly 102 and are configured to mate with reciprocal features of a second circuit board (not shown in FIG. 1). The header assembly 102 may be separated from a top surface of the second circuit board by a spacer 114. The mezzanine connector system 100 may interconnect the first and second circuit boards, which may be parallel to one another.

Alternatively, instead of a mezzanine connector system, the system may be used with respect to various other electrical connector systems that are configured to electrically connect circuit boards together. For example, the electrical connector system may be used to connect two separate and distinct circuit boards together in a right angle orientation.

Additionally, instead of a header assembly, the component assembly may be various other types of separable assemblies of an electrical connector assembly. In short, the assembly 102 may be any type of component assembly or separable portion of an electrical connector assembly.

Figure 2:
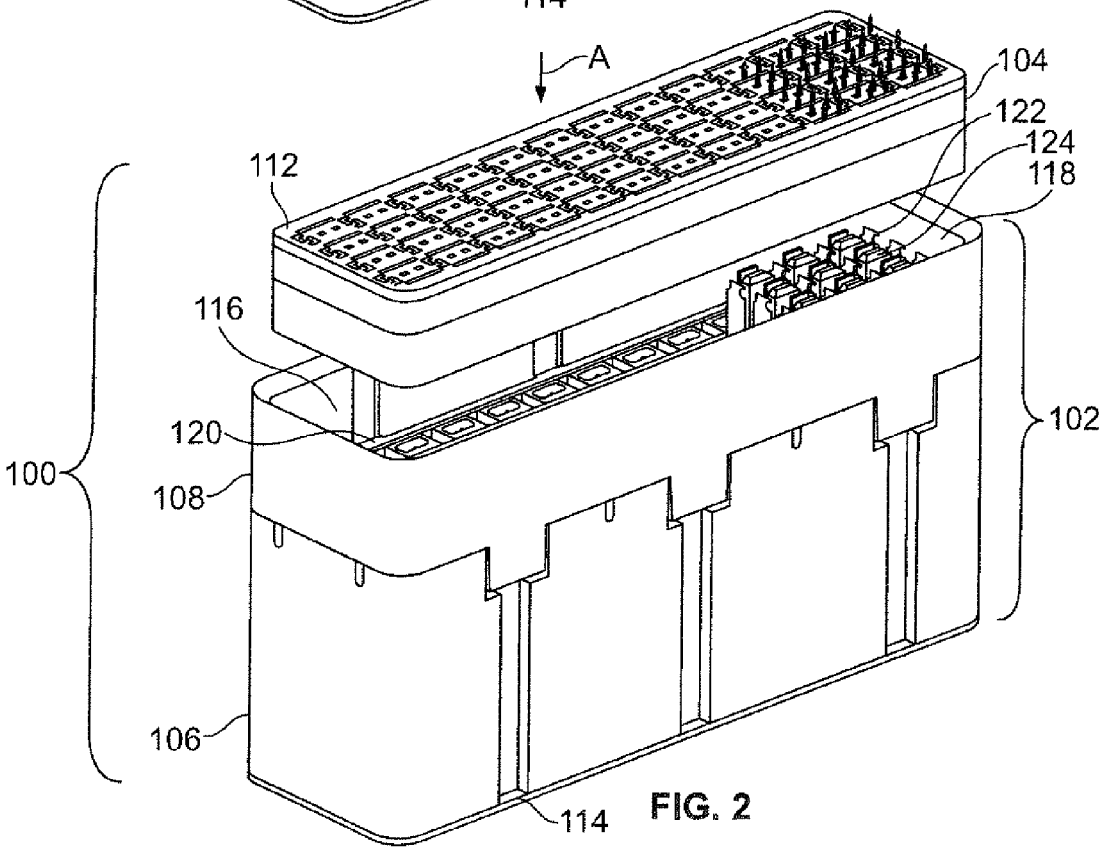
FIG. 2 illustrates a perspective top view of a mezzanine connector system with a receptacle assembly removed from the header assembly, according to an embodiment of the present disclosure.

FIG. 2 illustrates a perspective top view of the mezzanine connector system 100 with the receptacle assembly 104 removed from the header assembly 102, according to an embodiment of the present disclosure. The mating shroud 108 defines an internal mating chamber 116 between internal wall surfaces 118 and a base 120. A plurality of ground shields 122 are secured within the internal chamber 116. The ground shields 122 may be positioned around (for example, bounding or otherwise surrounding) portions of signal modules 124 that extend upwardly from the base 120. The receptacle assembly 104 is urged in the direction of arrow A into the internal chamber 116 in order to mate with the header assembly 102. Alternatively, the mating shroud 108 may not include the base 120, for example.

Figure 3:
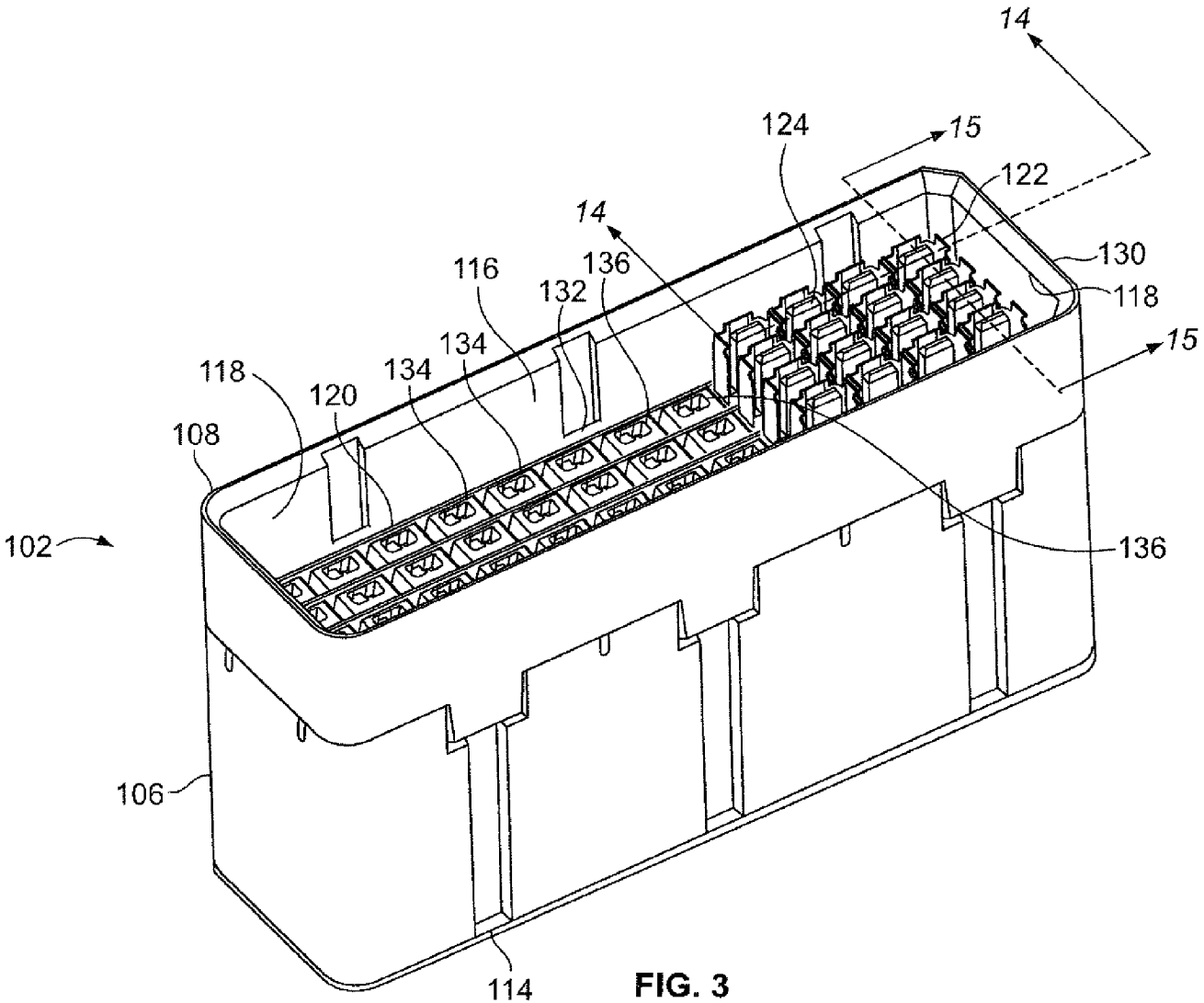
FIG. 3 illustrates a perspective top view of a header assembly, according to an embodiment of the present disclosure.

FIG. 3 illustrates a perspective top view of the header assembly 102, according to an embodiment of the present disclosure. The mating shroud 108 may include a perimeter wall 130 that upwardly extends from outer edge portions of the base 120. The internal mating chamber 116 is defined between the internal wall surfaces 118 of the perimeter wall 130 and an upper surface 132 of the base 120.

A plurality of signal channels 134 and ground channels 136 are formed through the base 120. The signal and ground channels 134 and 136 may extend from and through the upper surface 132 to and through a bottom surface (hidden from view) that overlies a top surface of the main housing 106. The signal and ground channels 134 and 136 align with signal and ground channels (not shown in FIG. 3) formed in the main housing 106.

Each signal channel 134 is configured to receive and retain a portion of a signal module 124. Each ground channel 136 is configured to receive and retain a portion of a ground shield 122. As shown in FIG. 3, not all of the signal channels 134 and the ground channels 136 are shown retaining respective signal modules 124 and ground shields 122. It is to be understood that signal modules 124 may be retained by each of the signal channels 134 and ground shields 122 may be retained by each of the ground channels 136. Further, the header assembly 102 may be configured to retain more or less signal modules 124 and ground shields 122 in more or less rows and columns than shown.

The mating shroud 108 provides a contact organizer that may eliminate, minimize, or otherwise reduce metal flaking as the receptacle assembly 104 (shown in FIGS. 1 and 2) is mated and unmated with the header assembly 102. The mating shroud 108 provides a protective structure that aligns and securely retains various ground connecting members, such as ground shields. Alternatively, the header assembly 102 may not include the mating shroud 108.

The main housing 106 may be formed of a solid material, such as a die cast or molded metal, plated plastic (for example, a plastic inner body that is formed of plastic that is electro-plated, electro-less plated, sputtered, or the like with a metal, such as nickel). As noted above, the main housing 106 and the mating shroud 108 may be separate and distinct components. The mating shroud 108 may be configured to removably secure to the main housing 106, such as through a latchable and/or snapable connection. In at least one embodiment, the main housing 106 may be integrally formed and molded from a first material, such as a first metal, while the mating shroud 108 may be integrally formed and molded from the first material or a second material, such as a second metal, or a plastic. After the main housing 106 and the mating shroud 108 are formed, the mating shroud 108 may be secured to the main housing 106.

Alternatively, the mating shroud 108 and the main housing 106 may be integrally formed and molded as a single, unitary piece. For example, a single mold may be used to form the unitary construction, which may be formed from a single material, such as injection-molded metal. In another embodiment, a two-shot molding process may be used. First, the main housing 106 may be formed of a first moldable metal, and then the mating shroud 108 may be overmolded (such as through injection-molded plastic) onto the main housing 106. In this embodiment, the mating shroud 108 may be permanently bonded to the main housing 106.

Figure 4:
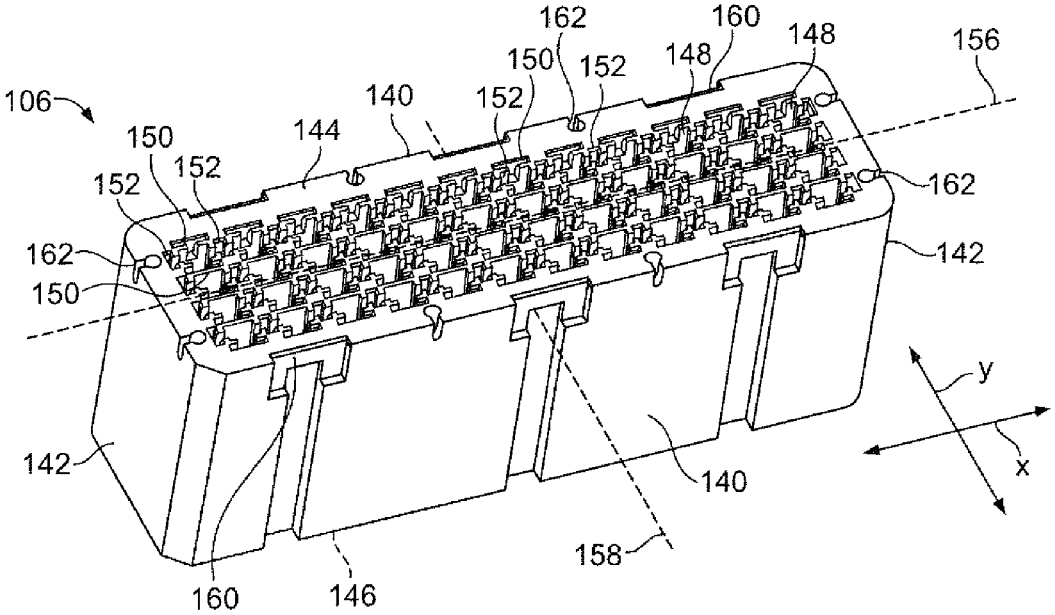
FIG. 4 illustrates a perspective top view of a main housing, according to an embodiment of the present disclosure.

FIG. 4 illustrates a perspective top view of the main housing 106, according to an embodiment of the present disclosure. As noted above, the main housing 106 may be integrally molded and formed as a single piece, such as a single piece of injection-molded or die cast conductive metal. The main housing 106 provides a ground housing (that is, a path to ground) for the mezzanine connector system 100 (shown in FIGS. 1-2). In at least one embodiment, the main housing 106 may be plated with electroless nickel, for example.

The main housing 106 includes opposed side walls 140 integrally connected to opposed end walls 142, a top surface 144, and a bottom surface 146. A plurality of signal channels 148 extend through the main housing 106 from and through the top surface 144 to and through the bottom surface 146. Each signal channel 148 is configured to align with a signal channel 134 of the mating shroud 108 (shown in FIG. 3). Each signal channel 148 is configured to receive and retain a portion of a signal module.

A plurality of ground channels 150 and 152 extend into the main housing 106 from the top surface 144. The plurality of ground channels 150 and 152 may not extend through an entire depth of the main housing 106. Instead, the plurality of ground channels 150 and 152 may extend from the top surface 144 to a depth above the bottom surface 146. Each ground channel 150 and 152 is configured to receive and retain a portion of a ground shield.

The ground channels 150 may be aligned with a central longitudinal axis 156 of the main housing 106. The central longitudinal axis 156 may extend through a center of the main housing 106 between the end walls 142. The central longitudinal axis 156 may be parallel with an x-axis. The ground channels 152 may be aligned with a central cross axis 158, which may extend through a center of the main housing 106 between the side walls 140. The central cross axis 158 is parallel with a y-axis, which is orthogonal to the x-axis.

Latch retainers 160 may be formed in the side walls 140. Each latch retainer 160 may include a recessed area that extends downwardly from the top surface 144 into the side wall 140. Each latch retainer 160 is configured to receive and latchably retain a latch member of the mating shroud 108. As shown, the main housing 106 may include six latch retainers 160. Alternatively, the main housing 106 may include more or less latch retainers 160 than shown, depending on the number of latch members of the mating shroud 108. Also, while not shown, latch retainers may be formed on the end walls 142. Alternatively, various other retainers, such as press-fit features, may be used to securely engage the mating shroud 108.

The main housing 106 may also include a plurality of alignment pin retainers 162 formed around a periphery of the top surface 144. Each alignment pin retainer 162 may be or include a reciprocal channel that is configured to receive an alignment pin of the mating shroud 108. The latch-retainers 160 and the alignment pin retainers 162 are configured to align and securely connect the mating shroud 108 to the main housing 106 by latchably and/or snapably retaining the latches and pins of the mating shroud 108.

Figure 5:
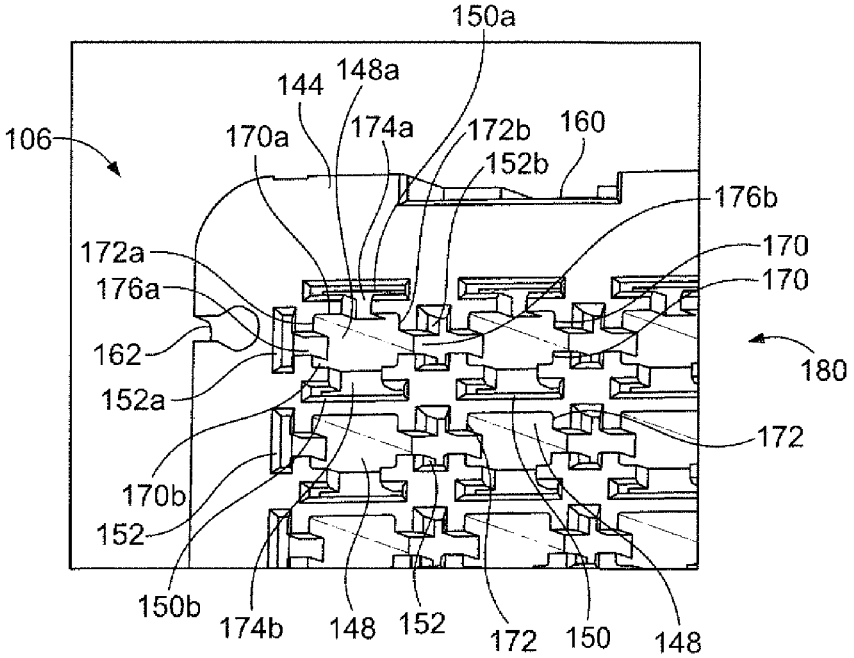
FIG. 5 illustrates a perspective top view of a portion of a top surface of a main housing, according to an embodiment of the present disclosure.

FIG. 5 illustrates a perspective top view of a portion of the top surface 144 of the main housing 106, according to an embodiment of the present disclosure. A ground channel 150*a* may be positioned to one side 170*a* of a signal channel 148*a*, while a ground channel 150*b* may be positioned to an opposite side 170*b* of the signal channel 148*a*. The ground channels 150*a* and 150*b* may reside in planes that are parallel with one another. A ground channel 152*a* may be positioned to one end 172*a* of the signal channel 148*a*, while a ground channel 152*b* may be positioned to an opposite end 172*b* of the signal channel 148*a*. The ground channels 152*a* and 152*b* may reside in planes that are parallel to one another, but perpendicular to the planes in which the ground channels 150*a* and 150*b* reside.

As shown, the ground channels 152*a* along the periphery of the top surface 144 may be sized and shaped to retain a portion of a single ground shield. However, the ground channels 152*b* that are disposed further within the top surface 144 may be sized and shaped to retain portions of two ground shields. For example, the ground channels 152*b* may have double the width as the ground channels 152*a*, in order to accommodate portions of neighboring ground shields.

The ground channels 150*a* and 150*b* may connect to the signal channel 148*a* through respective slots defined by recessed ledges 174*a* and 174*b*, respectively. Similarly, the ground channels 152*a* and 152*b* may connect to the signal channel 148*a* through respective slots defined by recessed ledges 176*a* and 176*b*, respectively. The recessed ledges 174*a*, 174*b*, 176*a*, and 176*b* may provide supporting surfaces for ground shields, for example. Referring to FIGS. 4 and 5, each of the signal channels 148 within a terminal row 180 (for example, an outermost row) may connect to the ground channels 150*a*, 150*b*, 152*a*, and 152*b* through slots. However, the signal channels 148 in rows other than the terminal row 180 may connect to two ground channels 152 through slots and one ground channel 150 through a slot. Alternatively, each of the signal channels 148 may connect to two ground channels 152 and two ground channels 150 through slots. As shown, whether or not connected through slots, each signal channel 148 is bounded on both sides 170 and both ends 172 by a ground channel 150 and 152, respectively.

Figure 6:
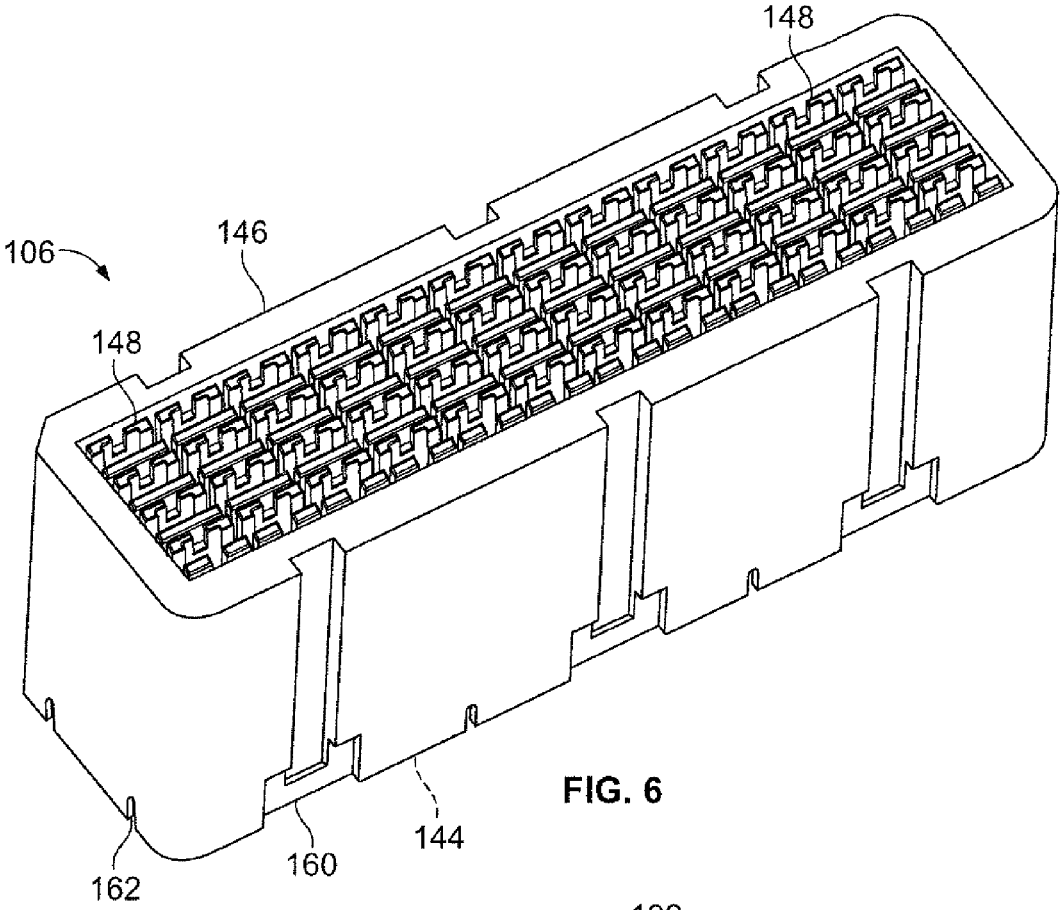
FIG. 6 illustrates a perspective bottom view of a main housing, according to an embodiment of the present disclosure.
Figure 7:
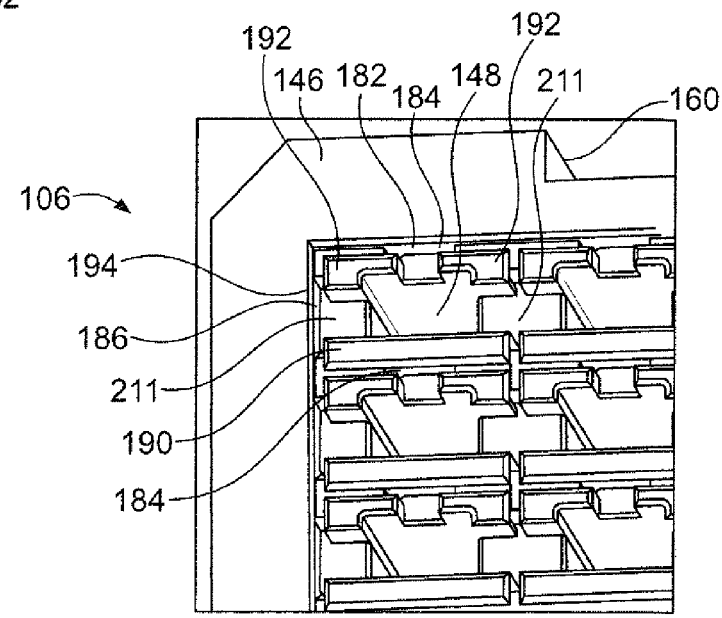
FIG. 7 illustrates a perspective bottom view of a portion of a bottom surface of a main housing, according to an embodiment of the present disclosure.

FIG. 6 illustrates a perspective bottom view of the main housing 106, according to an embodiment of the present disclosure. FIG. 7 illustrates a perspective bottom view of a portion of the bottom surface 146 of the main housing 106, according to an embodiment of the present disclosure. Referring to FIGS. 6 and 7, as shown, the signal channels 148 extend from the top surface 144 (shown in FIGS. 4 and 5) to and through the bottom surface 146. Ground contact retaining slots 184 formed through recessed areas 182 may be positioned to each side of a signal channel 148, while ground contact retaining slots 186 may be positioned to each end of the signal channel 148. For example, ridges 190 and 192 may extend downwardly from the bottom surface 146 and slots and/or passages may be defined between outer portions of the ridges 190 and 192, and/or an outer boundary 194 extending around the bottom surface 146.

Figure 8:
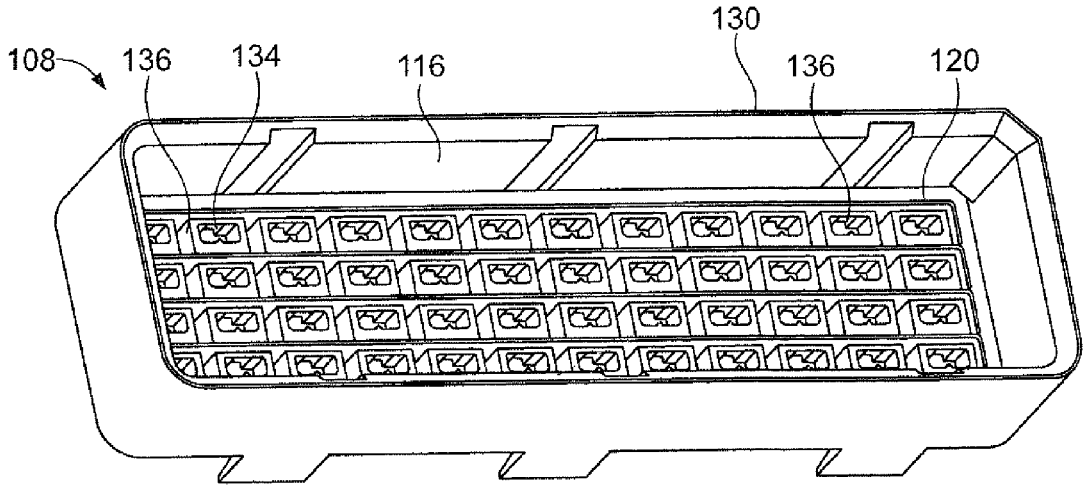
FIG. 8 illustrates a perspective top view of a mating shroud, according to an embodiment of the present disclosure.

FIG. 8 illustrates a perspective top view of the mating shroud 108, according to an embodiment of the present disclosure. As shown, the perimeter wall 130 upwardly extends from the outer edge portions of the base 120. The plurality of signal channels 134 and ground channels 136 are formed through the base 120.

Figure 9:
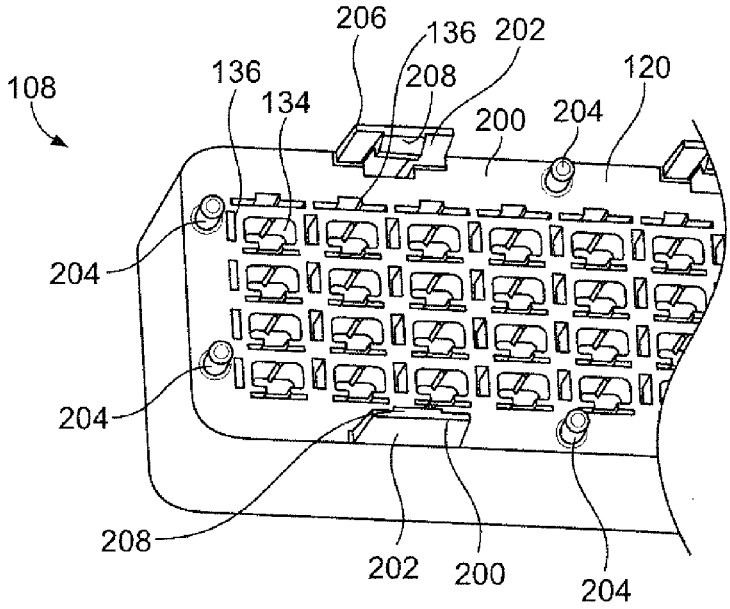
FIG. 9 illustrates a perspective bottom view of a portion of a bottom surface of a mating shroud, according to an embodiment of the present disclosure.

FIG. 9 illustrates a perspective bottom view of a portion of a bottom surface 200 of the mating shroud 108, according to an embodiment of the present disclosure. Latch members 202 extend downwardly from the peripheral portions of the bottom surface 200 of the base 120. Similarly, alignment pins 204 extend downwardly from the bottom surface 200 of the base 120. The alignment pins 204 are configured to align the mating shroud 108 with respect to the main housing 106 by being moved into and retained within pin retainers 162 formed in the main housing 106 (shown in FIGS. 4 and 5). Each latch member 202 may include an outer panel 206 connected to an inwardly-directed ramped surface 208, which is configured to securely latch onto a reciprocal feature of a latch retainer 160 (shown in FIGS. 4 and 5). In this manner, the alignment pins 204 may align the mating shroud 108 with respect to the main housing 106, while the latch members 202 latchably and/or snapably secure the mating shroud 108 to the main housing 106.

Figure 10:
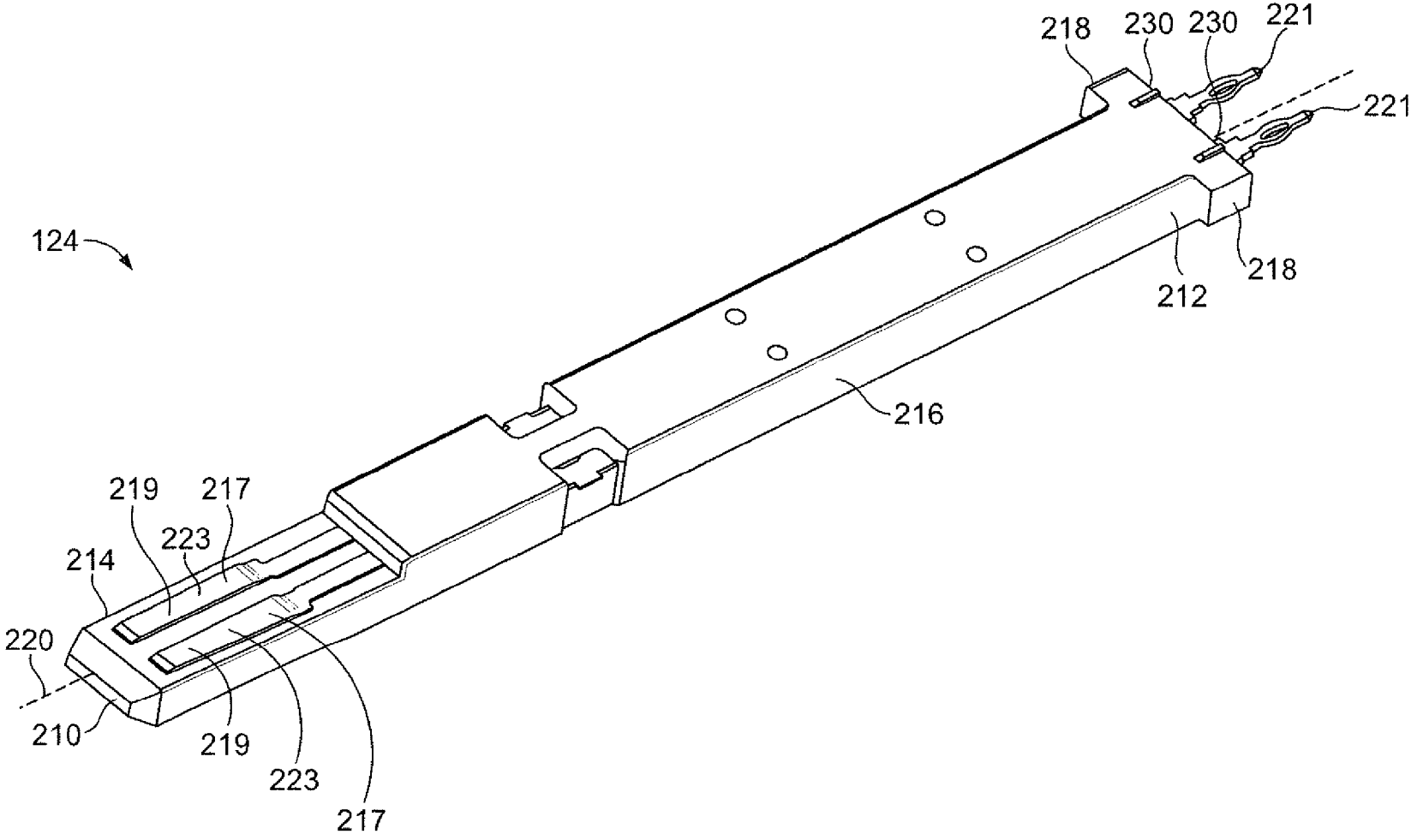
FIG. 10 illustrates a perspective view of a signal module, according to an embodiment of the present disclosure.

FIG. 10 illustrates a perspective view of a signal module 124, according to an embodiment of the present disclosure. The signal module 124 may be configured for edge-coupled or broad-side coupled signals, for example. The signal module 124 includes a carrier 216 that retains header signal pins 217. The carrier 216 may be formed of a dielectric material, such as a plastic, and may be overmolded onto the signal pins 217. The carrier 216 may be formed of various materials, such as plastics, to achieve a desired performance. For example, the carrier 216 may be formed of a first plastic that is configured to provide a first impedance, or another plastic that is configured to provide a second impedance that differs from the first impedance. In short, the carrier 216 may be impedance-tunable through the use of different dielectric materials. The carrier 216 may be a single piece of material that is overmolded onto the signal pins 217. Alternatively, the carrier 216 may include a separable body, such as one that may be snapped or latched together onto and over the signal pins 217. The carrier 216 and/or the main housing 106 (shown in FIG. 4, for example) may be selectively plated so as to provide a desired impedance, for example.

Additionally, the main housing 106 (shown in FIG. 4, for example) may be selectable from various configurations, such as one that is configured to accommodate various types of tunable carriers 216. For example, the main housing 106 may be selected from one that may accommodate various type of impedance tunable carriers 216. The main housing 106 may be select loaded with tunable carriers 216 by position, for example.

The carrier 216 includes a top receptacle-mating end 210 connected to a bottom header terminal end 212. The receptacle-mating end 210 may include a recessed area 214 that exposes contact tabs 219 of the signal pins 217. The header terminal end 212 may include outwardly-extending shoulders 218 that extend laterally away from a longitudinal axis 220 of the signal module 124.

As shown, the signal module 124 includes two signal pins 217. Alternatively, the signal module 124 may include a single signal pin. Also, alternatively, the signal module 124 may include more than two signal pins 217. Further, instead of eye-of-the-needle contacts and planar contacts tabs, the signal module 124 may include various other signal connecting interfaces.

Figure 11:
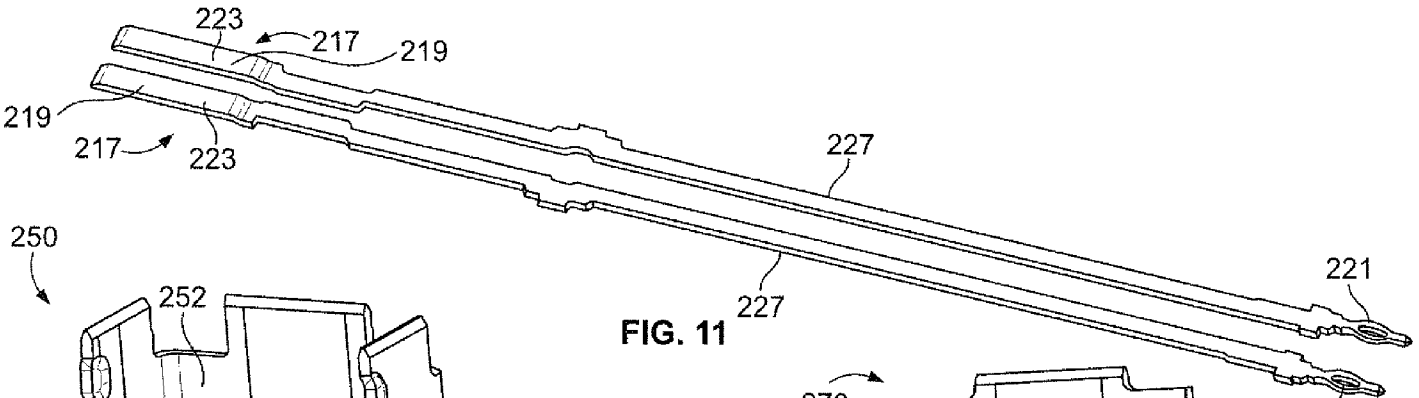
FIG. 11 illustrates a perspective view of a pair of header signal pins, according to an embodiment of the present disclosure.

FIG. 11 illustrates a perspective view of a pair of header signal pins 217, according to an embodiment of the present disclosure. Each signal pin 217 may include a contact tab 219 that connects to an eye-of-the-needle contact 221 through a longitudinal extension 227. Referring to FIGS. 10 and 11, the contacts 221 extend downwardly from the bottom header terminal end 212, while inner surfaces 223 of the contacts tabs 219 are exposed in the recessed area 214.

As shown in FIG. 10, retention protuberances 230 may outwardly extend from outer surfaces of the carrier 216. The retention protuberances 230 may be or include outwardly-extending tabs, ribs, fins, or the like. As shown, the retention protuberances 230 may outwardly extend from the carrier 216 proximate to the header terminal end 212. While two retention protuberances 230 are shown, more or less may extend from the carrier. Further, additional retention protuberances extending from various other surfaces of the carrier 216 may be used. For example, retention protuberances may extend outwardly from any surface of the shoulders 218.

The retention protuberances 230 are configured to provide a tight, secure fit within a signal channel. For example, as the signal module 124 is urged into a signal channel, the retention protuberances 230 may be too large to fit within the signal channel 148 (FIG. 5). However, the retention protuberances 230 may have curved lead-in features that allow the signal module 124 to further slide within the signal channel, at which point the retention protuberances 230 may inwardly deflect, deform, or the like, so as to fit within the signal channel and provide a tight, secure connection with the signal channel.

Figure 12:
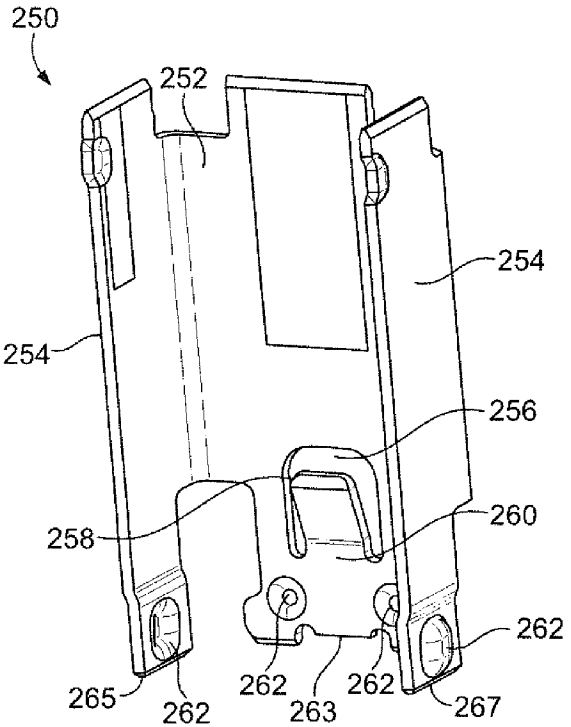
FIG. 12 illustrates a perspective view of a ground shield, according to an embodiment of the present disclosure.

FIG. 12 illustrates a perspective view of a ground shield 250, according to an embodiment of the present disclosure. The ground shield 250 may be a C-shield (its axial cross-section forming a block C-shape) including a main beam 252 connected to end beams 254. The main beam 252 resides within a plane that may be perpendicular to planes in which the end beams 254 reside. Alternatively, the main beam 252 may connect to the end beams 254 through smooth curves.

A deflection channel 256 may be formed through a portion of the main beam 252. A resilient securing tab 258 extends to a side of the deflection channel 256 from a flexible root 260 that connects to the main beam 252. Outwardly-extending retention protuberances 262, such as hemispherical dimples, extend from lower portions of the main beam 252 and the end beams 254.

Figure 13:
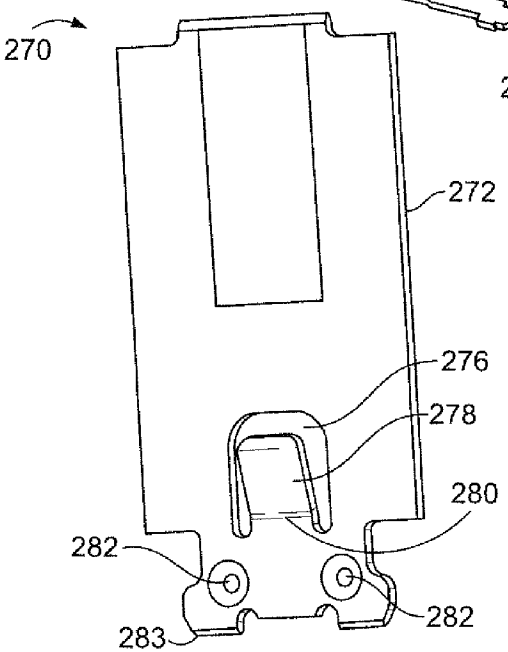
FIG. 13 illustrates a perspective view of a ground shield, according to an embodiment of the present disclosure.

FIG. 13 illustrates a perspective view of a ground shield 270, according to an embodiment of the present disclosure. The ground shield 270 may include single main beam 272 without any end beams. A deflection channel 276 is formed through a portion of the beam 272. A resilient securing tab 278 extends to a side of the deflection channel 276 from a flexible root 280 that connects to the beam 272. Outwardly-extending retention protuberances 282, such as hemispherical dimples, extend from lower portions of the beam 272.

Referring to FIGS. 5, 8, 9, 12, and 13, the ground shield 250 is configured to be secured to the main housing 106 and the mating shroud 108 such that a bottom portion 263 of the main beam 252 is retained within the ground channel 150*b*, while bottom portions 265 and 267 of the end beams 254 are retained within the ground channels 152*a* and 152*b*, respectively. The retention protuberances 262 may deflect inwardly as the bottom portions 263, 265, and 267 are urged into the ground channels 150*b*, 152*a*, and 152*b*, respectively, and flex back into an at-rest position to provide secure engagement with ground channels 150*b*, 152*a*, and 152*b*. In a similar fashion, a bottom portion 283 of the ground shield 270 is retained within the ground channel 150*a*. The retention protuberances 282 ensure that the bottom portion 283 is securely retained within the ground channel 150*a*.

Figure 14:
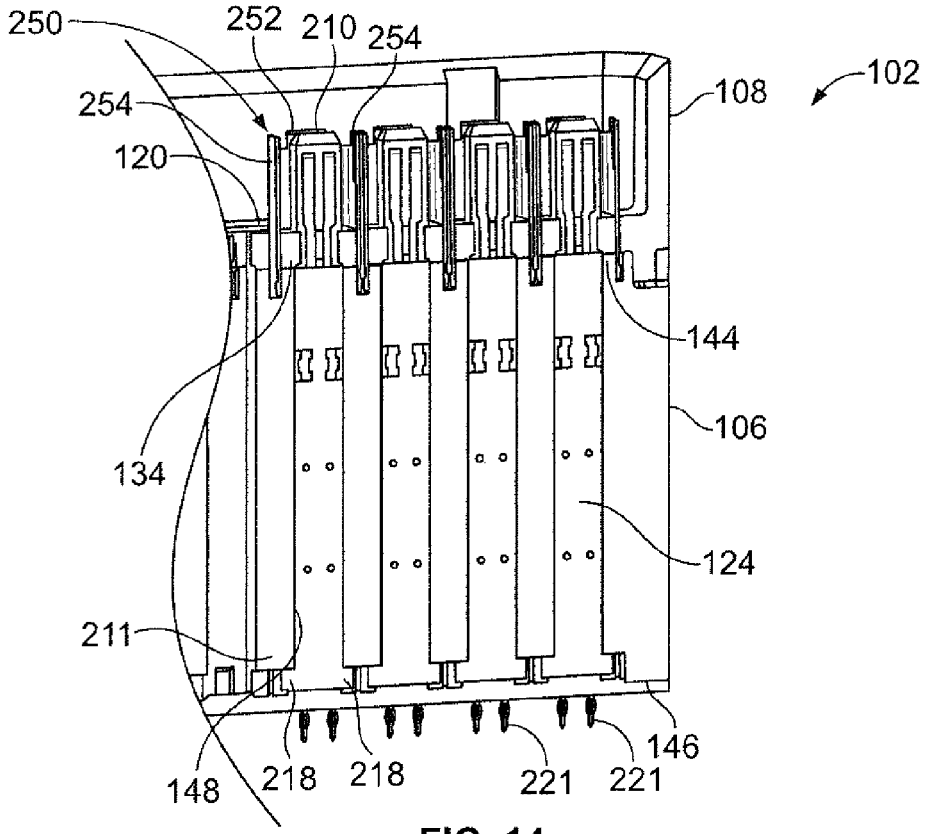
FIG. 14 illustrates a perspective, partial cross-sectional view of a header assembly through line 14-14 of FIG. 3, according to an embodiment of the present disclosure.

FIG. 14 illustrates a perspective, partial cross-sectional view of the header assembly 102 through line 14-14 of FIG. 3, according to an embodiment of the present disclosure. Each signal module 124 may be inserted into a signal channel 148 through a bottom surface 146 of the main housing 106. As the signal module 124 is urged into the signal channel 148, the receptacle mating end 210 extends through the top surface 144 and through the signal channel 134 of the mating shroud 108. The signal module 124 continues to be urged into the signal channel 148 until the shoulder 218 abuts against ledges 211 of the bottom surface 146 of the main housing 106. The ledges 211 prevent further movement of the signal modules 124 into the main housing 106 such that the receptacle mating ends 210 are at a desired height above the base 120 of the mating shroud 108. The retention protuberances 230 (shown in FIG. 10) may be inwardly-compressed (such as being crushed) within the signal channels 148, thereby providing increased retaining strength.

The ground shields 250 are retained within ground channels formed in the main housing 106 and the mating shroud 108, as described above. As shown, each main beam 252 is disposed with respect to a side of the receptacle mating end 210 (the main beam 252 of another ground shield 250 and/or a ground shield 270 may be disposed with respect to an opposite side of the receptacle mating end 210) of a signal module 124, while the end beams 254 are disposed with respect to either side of the receptacle mating end 210.

Figure 15:
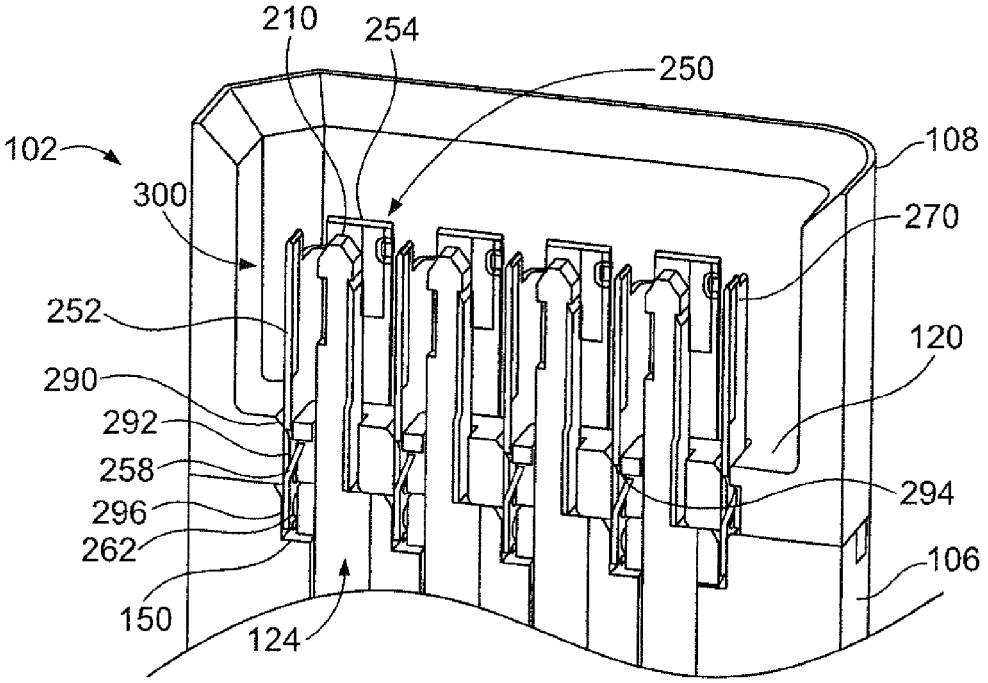
FIG. 15 illustrates a perspective, partial cross-sectional view of a header assembly through line 15-15 of FIG. 3, according to an embodiment of the present disclosure.

FIG. 15 illustrates a perspective, partial cross-sectional view of the header assembly 102 through line 15-15 of FIG. 3, according to an embodiment of the present disclosure. In order to insert the ground shields 250 (or 270), the main beam 252 is aligned with a ground channel 290 of the mating shroud 108 (while the side beams 254 are aligned with reciprocal ground channels). The bottom portions 263 and 265 (shown in FIG. 12) of the main beam 252 and the side beams 254, respectively, are urged into the reciprocal ground channels. As the ground shield 250 moves into the ground channel 290, the resilient securing tab 258 deflects into the deflection channel 256 (shown in FIG. 12, for example), and passes therethrough until it reaches an expanded internal chamber 292 defined, in part, by an upper ledge 294. As the resilient securing tab 258 passes into the internal chamber 292, the securing tab 258 flexes back to its at-rest position and hooks onto the upper ledge 294, thereby securely retaining the ground shield 250 in position. The retention protuberances 262 may project into interior wall portions of the main housing 106 that define a ground channel 150.

The ground shield 270 may secure to the header assembly 102 in a similar fashion. As shown in FIG. 15, each column 300 of ground shields may include a plurality of ground shields 250 and a single ground shield 270 at a terminal end. As shown, each ground shield 250 bounds one side and two ends of a receptacle mating end 210 of a signal module 124, while another ground shield 250 bounds opposite sides of portions of neighboring signal modules 124. The single ground shield 270 is positioned to one side of a terminal signal module 124.

Alternatively, each ground shield may simply be a planar beam. As such, each receptacle mating end 210 of each signal module 124 may be bounded on each side or end by a separate and distinct ground shield. For example, each side of the receptacle mounting end 210 may be bounded by a single ground shield, while each end of the receptacle mounting end 210 may be bounded by a single ground shield.

As shown in FIGS. 14 and 15, each of the ground shields 250 within the header assembly 102 may be oriented in a common direction. Alternatively, ground shields 250 within different columns and/or rows may be oriented in opposed directions. For example, ground shields 250 may be oriented in a first direction in a first column, and a second direction that is opposite the first direction in a second column that is next to the first column. Further, the header assembly 102 may use only the ground shields 250 or the ground shields 270 to bound or otherwise surround portions of the signal modules 124. For example, a receptacle mating end 210 may be bounded by four separate and distinct ground shields (as opposed to one ground shield 250 and another ground shield 250 or 270).

Figure 16:
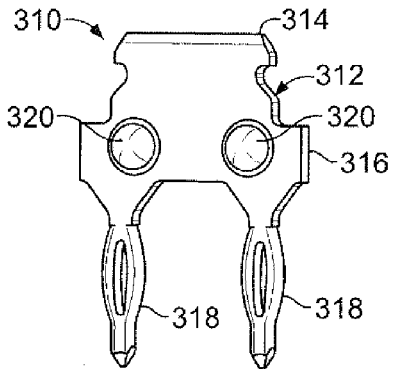
FIG. 16 illustrates a front view of a bottom header ground contact, according to an embodiment of the present disclosure.

FIG. 16 illustrates a front view of a bottom header ground contact 310, according to an embodiment of the present disclosure. The bottom header ground contact 310 includes a main body 312 having an upper header contacting edge 314 connected to an intermediate portion 316. Two eye-of-the-needle contacts 318 extend downwardly from the intermediate portion 316. Two retention protuberances 320 outwardly extend from the intermediate portion 316. Alternatively, the bottom header ground contact 310 may be various other contact interfaces other than eye-of-the-needle contacts.

Figure 17:
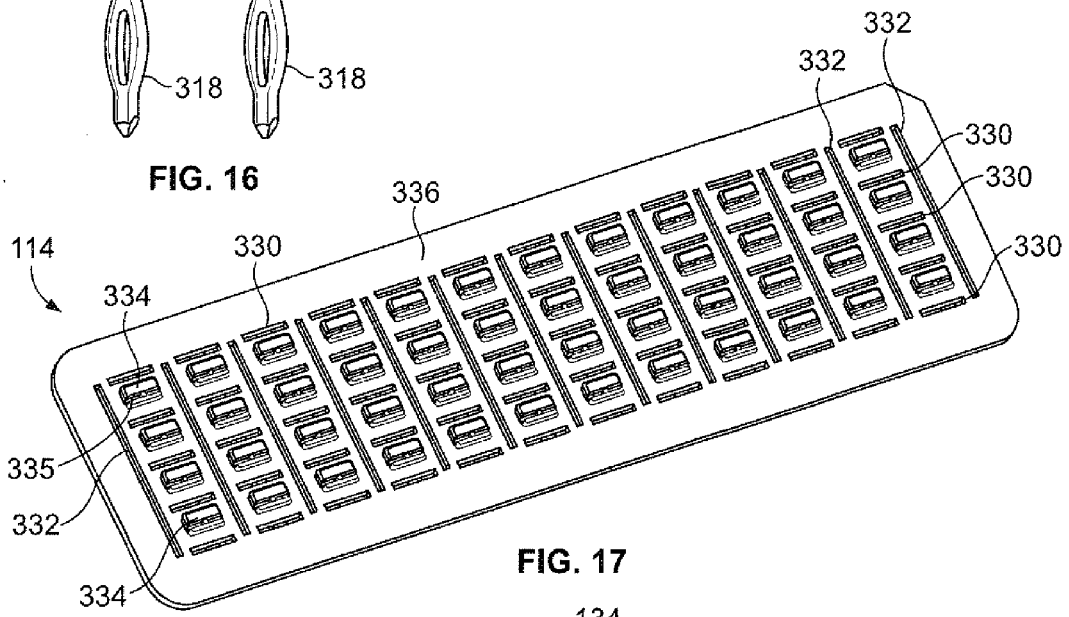
FIG. 17 illustrates a perspective top view of a spacer, according to an embodiment of the present disclosure.

FIG. 17 illustrates a perspective top view of the spacer 114, according to an embodiment of the present disclosure. The spacer 114 includes a plurality of ground channels 330 arranged in parallel rows, and a plurality of ground channels 332 arranged in parallel columns that are orthogonal to the rows of ground channels 330. Separating protuberances 334, such as upstanding ribs, ridges, beams, or the like, on opposite sides of signal channels 335 upwardly extend from a top surface 336 of the spacer 114. Alternatively, the spacer 114 may not be used with embodiments of the present disclosure.

Figure 18:
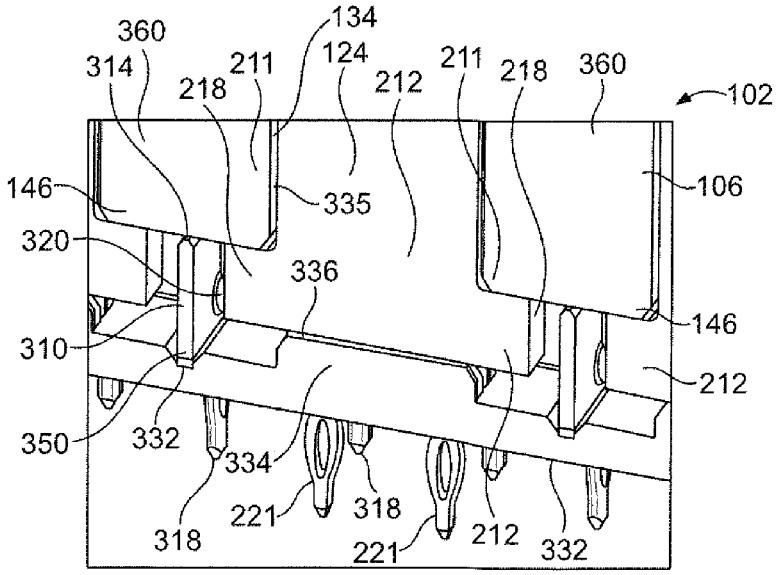
FIG. 18 illustrates a perspective, partial cross-sectional view of a spacer secured to a header assembly, according to an embodiment of the present disclosure.

FIG. 18 illustrates a perspective, partial cross-sectional view of the spacer 114 secured to the header assembly 102, according to an embodiment of the present disclosure. As shown, bottom edges 350 of the intermediate portions 316 of the bottom header ground contacts 310 are retained within the ground channels 332, with the eye-of-the-needle contacts 318 extending downwardly through openings formed therethrough. The header contacting edges 314 abut into the ledges 211 of the internal walls 360 of the main housing 106. The shoulders 218 of the signal modules 124 are sandwiched between the ledges 211 and at least a portion of the top surface 336 of the spacer 114. The retention protuberances 320 abut into ends of the shoulders 218. The separating protuberances 334 may abut bottom surfaces of the signal modules 124 to provide adequate spacing with respect to a circuit board (not shown).

Referring to FIGS. 17 and 18, the eye-of-needle contacts 221 of the signal modules 124 extend downwardly through the signal channels 335. Bottom header ground contacts 310 are positioned on either side and either end of the header terminal ends 212 of the signal modules 212. For example, a first bottom header ground contact 310 may be disposed with respect to one end of a signal channel 335, a second bottom header ground contact 310 may be disposed with respect to the opposite end of the signal channel 335, while a third header bottom contact 310 may be disposed with respect to one side of the signal channel 335, while a fourth bottom header ground contact 310 may be positioned with respect to an opposite side of the signal channel 335.

Referring to FIGS. 14 and 18, each signal module 124 is bounded or otherwise surrounded by ground material through the header assembly. For example, the ground shields 250 and/or 270 bound or otherwise surround the receptacle mating ends 210, while internal ground walls of the main housing 106 bound or otherwise surround the lengths of the signal modules 124 within the signal channels 134, and the bottom header ground contacts 310 bound or otherwise surround the header terminal ends 212 of the signal modules 124. Accordingly, a ground path extends around each signal module 124 from the ground shields 250 and/or 270, through the main housing 106, and through the bottom header ground contacts 310.

The bottom header ground contacts 310 are shown as separate and distinct pieces that may be inserted onto the spacer 114 and contact the ledges 211 of the main housing 106. Alternatively, the bottom header ground contacts may be integrally molded and formed with the main housing 106.

Figure 19:
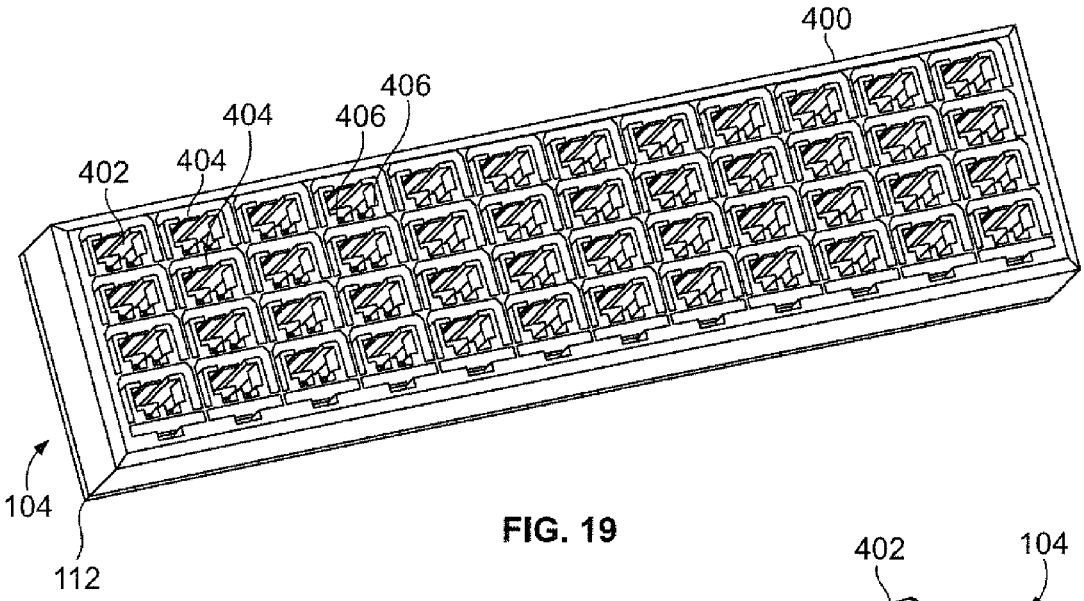
FIG. 19 illustrates a perspective bottom view of a receptacle assembly, according to an embodiment of the present disclosure.

FIG. 19 illustrates a perspective bottom view of the receptacle assembly 104, according to an embodiment of the present disclosure. The receptacle assembly 104 may include a main housing 400 defining a plurality of passages 402. As shown, the spacer 112 may be secured to a top surface of the main housing 400. Receptacle shield contact beams 404 extend into the passages 402. Signal contact beams 406 are positioned within the passages 402.

The receptacle assembly 104 may include more or less passages 402 than shown. For example, instead of four rows of twelve passages, the receptacle assembly 104 may include more or less rows and/or more or less passages.

Figure 20:
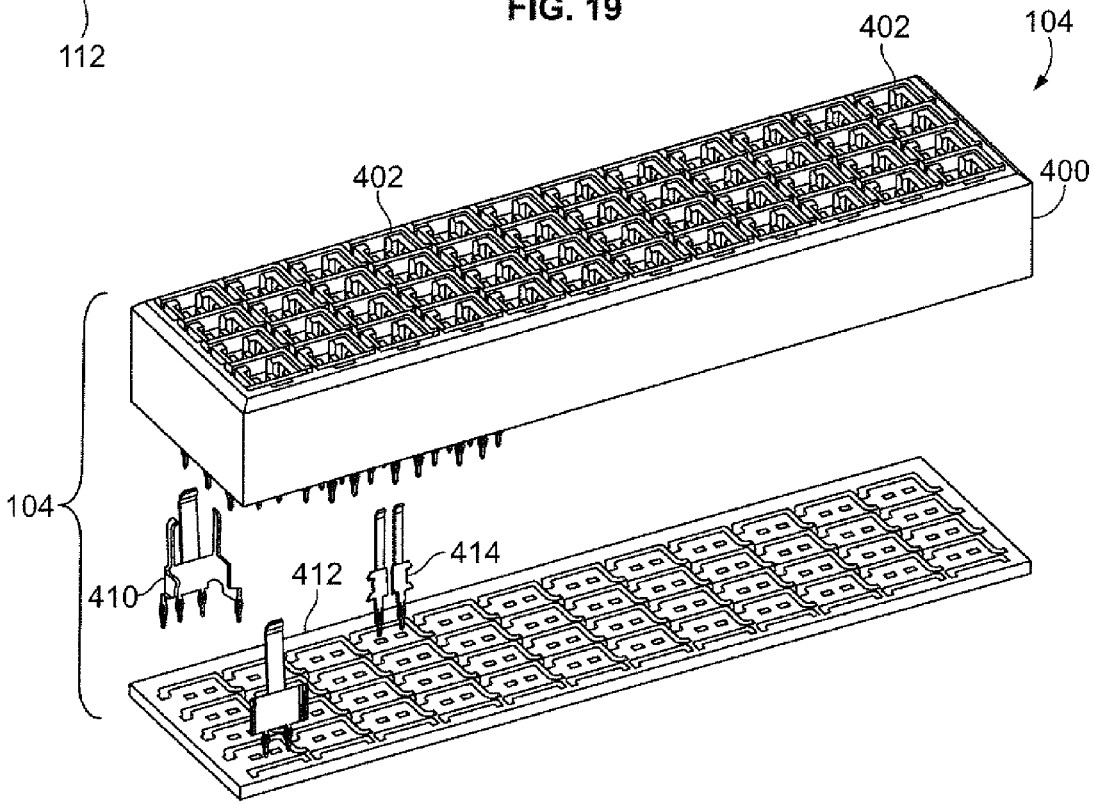
FIG. 20 illustrates a perspective bottom view of a receptacle assembly separated from a spacer, according to an embodiment of the present disclosure.

FIG. 20 illustrates a perspective bottom view of the receptacle assembly 104 separated from the spacer 112, according to an embodiment of the present disclosure. Receptacle shields 410 and 412 are secured with respect to the passages 402, such that signal contacts 414 are positioned within the passages 402 between two receptacle shields 410, or between a receptacle shield 410 and a receptacle shield 412. The signal contacts 414 are positioned within separate and distinct signal channels or portions of the passages 402 that may not otherwise retain ground material.

Figure 22:
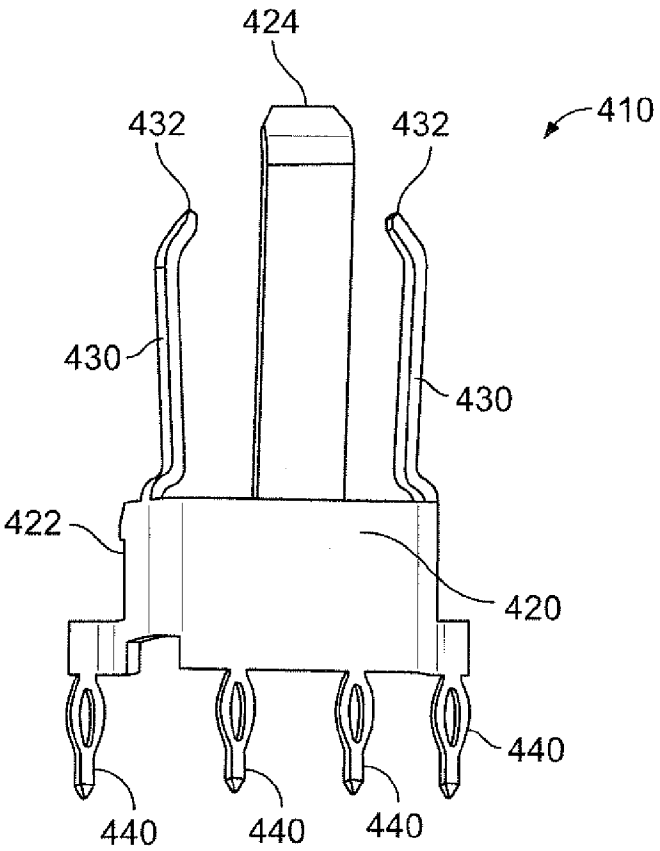
FIG. 22 illustrates a perspective rear view of a receptacle shield, according to an embodiment of the present disclosure.
Figure 21:
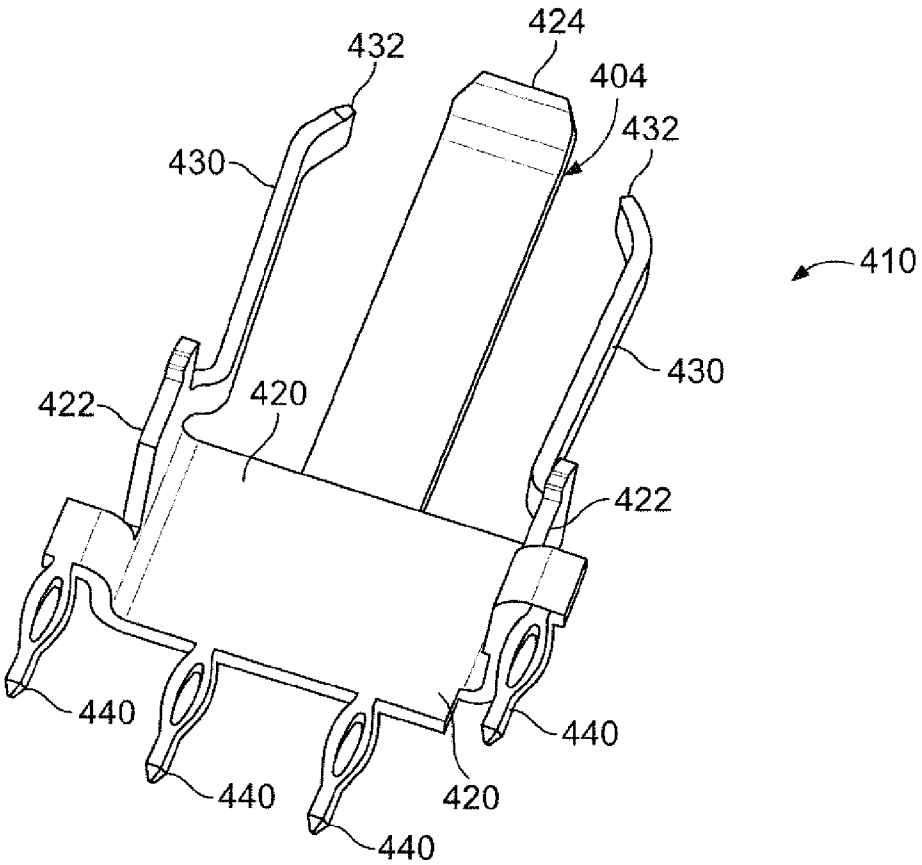
FIG. 21 illustrates a perspective front view of a receptacle shield, according to an embodiment of the present disclosure.

FIG. 21 illustrates a perspective front view of the receptacle shield 410, according to an embodiment of the present disclosure. FIG. 22 illustrates a perspective rear view of the receptacle shield 410. Referring to FIGS. 21 and 22, the receptacle shield 410 includes a main wall 420, such as a planar strap of material, and opposed end straps 422 extending from the main wall 420. The main wall 420 resides in a plane that may be orthogonal to the planes in which the end straps 422 reside. A receptacle shield contact beam 404 extends upwardly from the main wall 420 and may include an inwardly-canted distal tip 424. Similarly, end contacts beams 430 upwardly extend from the end straps 422 may also include inwardly-canted distal tips 432. Eye-of-the-needle contacts 440 may downwardly extend from the main wall 420 and the end straps 422. More or less contacts 440 may extend from the main wall 420 and/or the end straps 422. As shown in FIGS. 21 and 22, the receptacle shield contact beam 404 extends to a higher level than the contact beams 430.

Figure 23:
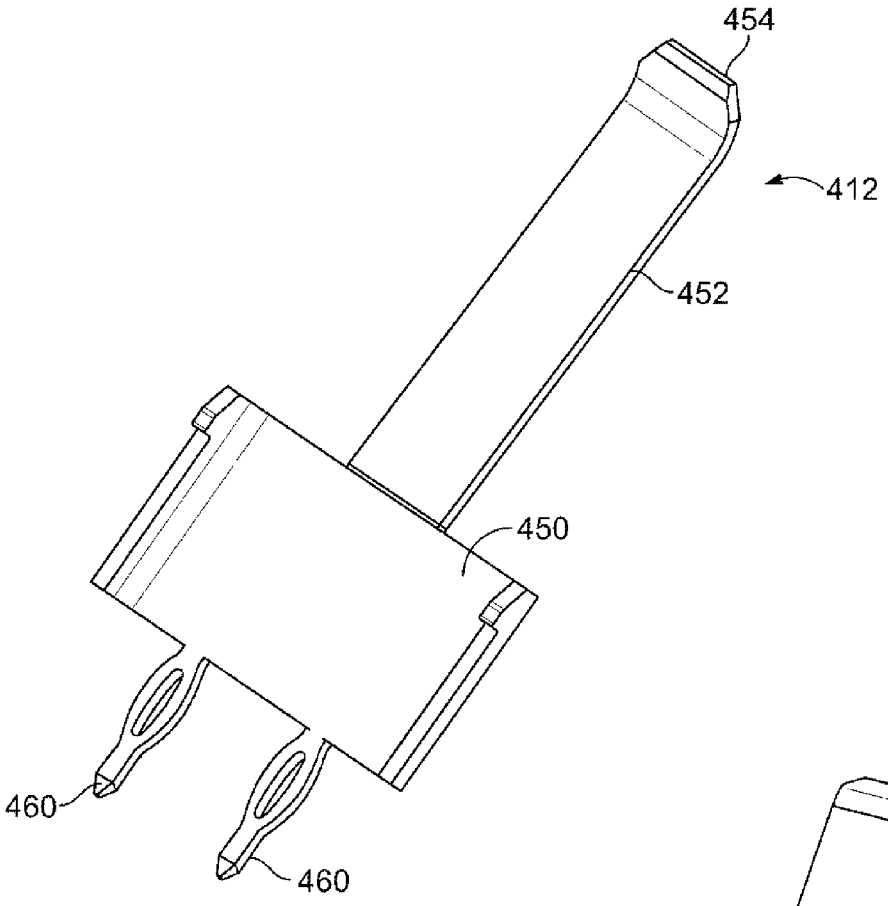
FIG. 23 illustrates a perspective front view of a receptacle shield, according to an embodiment of the present disclosure.
Figure 24:
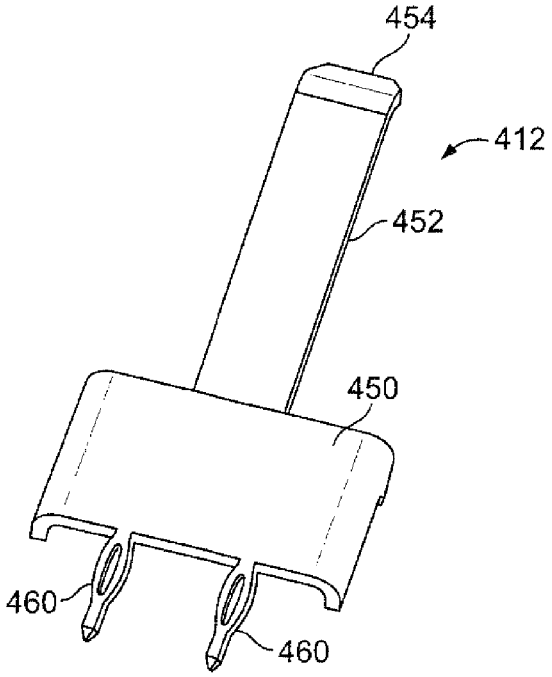
FIG. 24 illustrates a perspective rear view of a receptacle shield, according to an embodiment of the present disclosure.

FIG. 23 illustrates a perspective front view of the receptacle shield 412, according to an embodiment of the present disclosure. FIG. 24 illustrates a perspective rear view of the receptacle shield 412. Referring to FIGS. 23 and 24, the receptacle shield 412 includes a main wall 450, such as a planar strap of material. A receptacle shield contact beam 452 extends upwardly from the main wall 450 and may include an inwardly-canted distal tip 454. Eye-of-needle contacts 460 may downwardly extend from the main wall 450. More or less contacts 460 may extend from the main wall 450 and/or the end straps 422.

Figure 25:
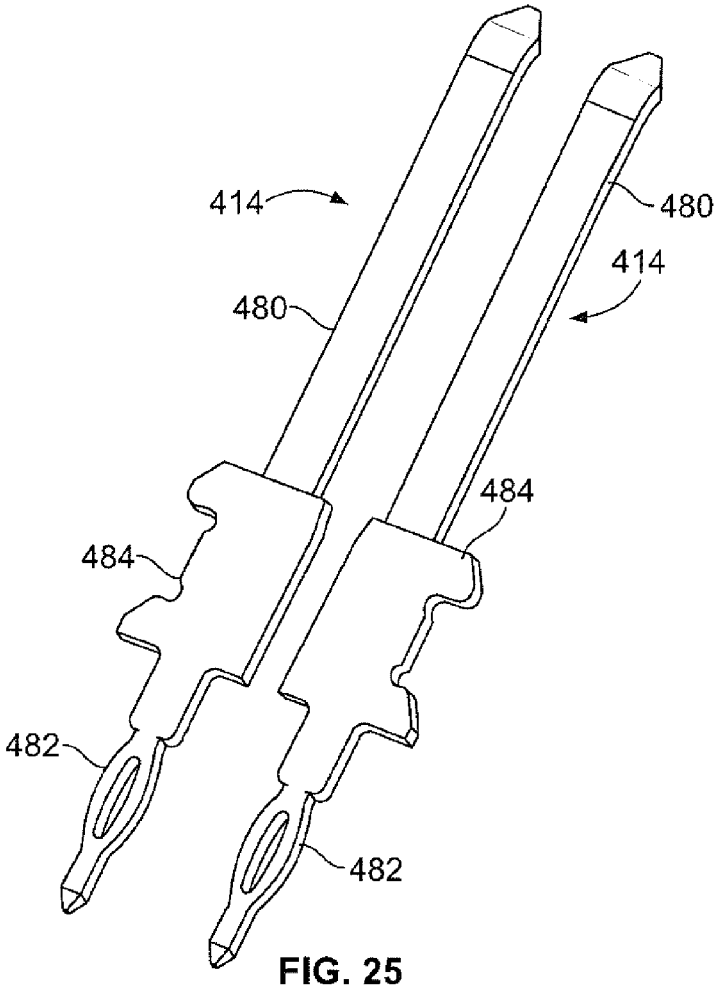
FIG. 25 illustrates a perspective view of a pair of signal contacts, according to an embodiment of the present disclosure.

FIG. 25 illustrates a perspective view of a pair of signal contacts 414, according to an embodiment of the present disclosure. Each signal contact 414 may include a signal contact beam 480 connected to an eye-of-the-needle contact 482 through an intermediate body 484.

Referring to FIGS. 19-25, a pair of signal contacts 414 may be retained within a passage 402. Each pair of signal contacts 414 is bounded on each side by a portion of the receptacle shield 410 and/or the receptacle shield 412.

Figure 26:
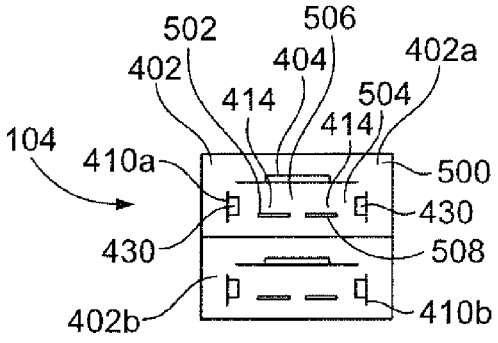
FIG. 26 illustrates a simplified plan view of two adjacent passages in a column of a receptacle assembly, according to an embodiment of the present disclosure.

FIG. 26 illustrates a simplified plan view of two adjacent passages 402*a* and 402*b* in a column 500 of the receptacle assembly 104, according to an embodiment of the present disclosure. As shown, a pair of signal contacts 414 is positioned within the passage 402*a*. The receptacle shield 410*a* bounds or otherwise surrounds opposite ends 502 and 504 and a side 506 of the pair of signal contacts 414. Another receptacle shield 410*b* is positioned with respect to an opposite side 508 of the pair of signal contacts 414.

Figure 27:
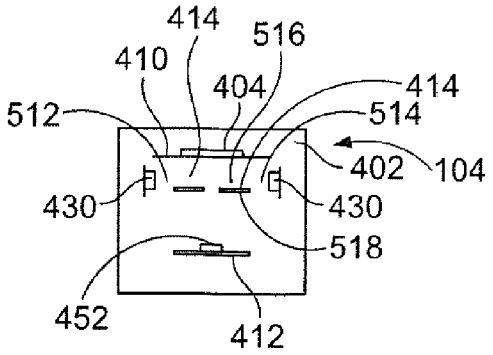
FIG. 27 illustrates a simplified plan view of a passage of a receptacle assembly, according to an embodiment of the present disclosure.

FIG. 27 illustrates a simplified plan view of a passage 402 of the receptacle assembly 104, according to an embodiment of the present disclosure. The passage 402 is at the end of a column. As shown, a pair of signal contacts 414 is positioned within the passage 402. The receptacle shield 410 bounds or otherwise surrounds opposite ends 512 and 514 and a side 516 of the pair of signal contacts 414. A receptacle shield 412 is positioned with respect to an opposite side 518 of the pair of signal contacts 414.

Figure 28:
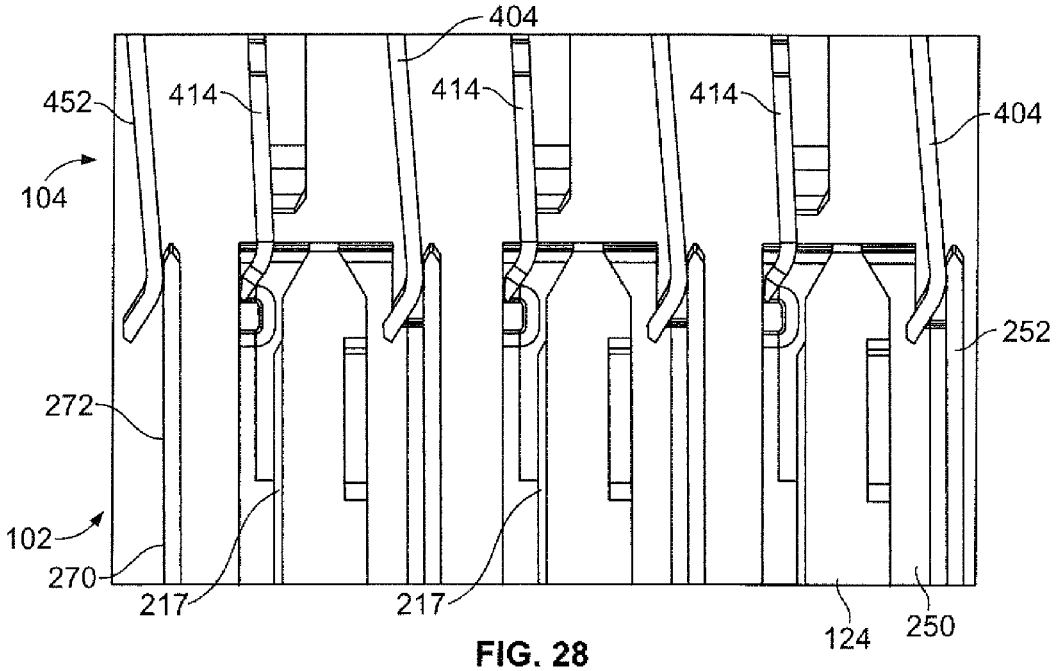
FIG. 28 illustrates an internal view of a receptacle assembly initially mating with a header assembly, according to an embodiment of the present disclosure.

FIG. 28 illustrates an internal view of the receptacle assembly 104 initially mating with the header assembly 102, according to an embodiment of the present disclosure. For the sake of clarity, various portions of the receptacle assembly 104 and the header assembly 102 are not shown in FIG. 28. Instead, only the signal and ground contacting portions are shown in FIG. 28.

As the receptacle assembly 104 is urged into the header assembly 102, the receptacle shield ground beams 404 and the receptacle shield ground beams 452 contact the main beams 252 of the ground shields 250 and the main beams 272 of the ground shields 270 of the header assembly 102 before the signal contacts 414 contact the signal module 124 (because the receptacle shield ground beams 404 and 452 are longer/taller than the signal contacts 414). In this manner, during the mating process, the header assembly 102 and the receptacle assembly 104 connect to ground before contact between signal components is made.

Figure 29:
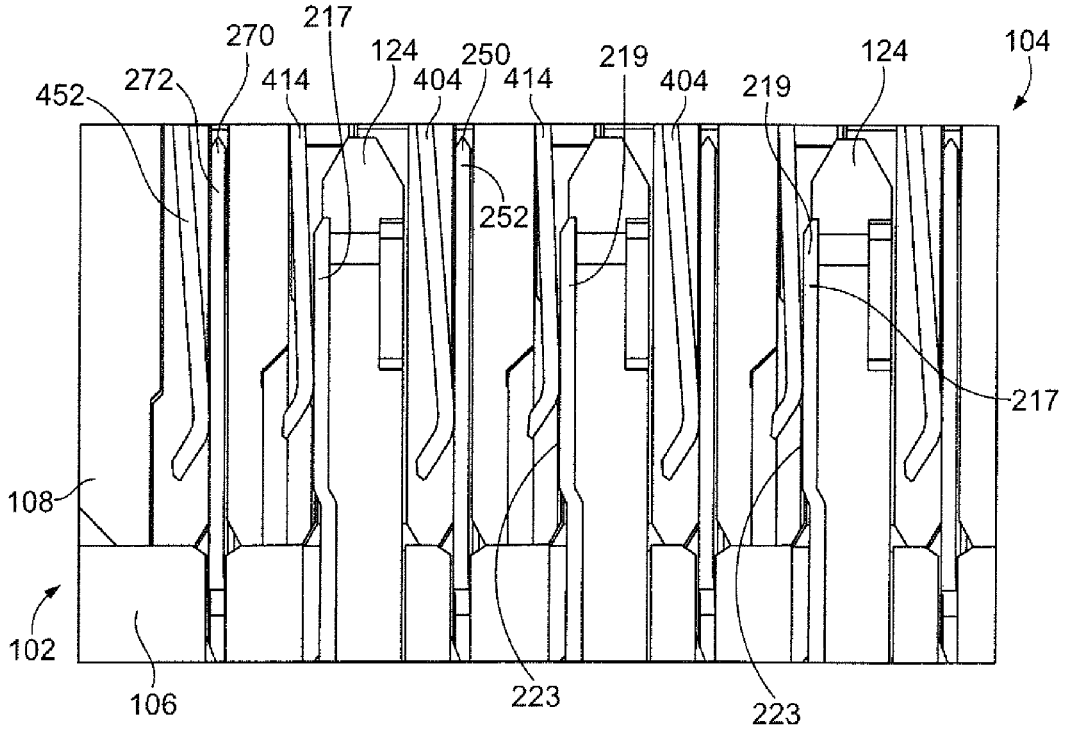
FIG. 29 illustrates an internal view of a receptacle assembly fully mated with a header assembly, according to an embodiment of the present disclosure.

FIG. 29 illustrates an internal view of the receptacle assembly 104 fully mated with the header assembly 102, according to an embodiment of the present disclosure. As shown, the receptacle shield ground beams 404 and 452 connect to the main beams 252 and 272, respectively, while the signal contacts 414 contact the inner surfaces 223 of the contacts tabs 219 of the signal modules 124.

Figure 30:
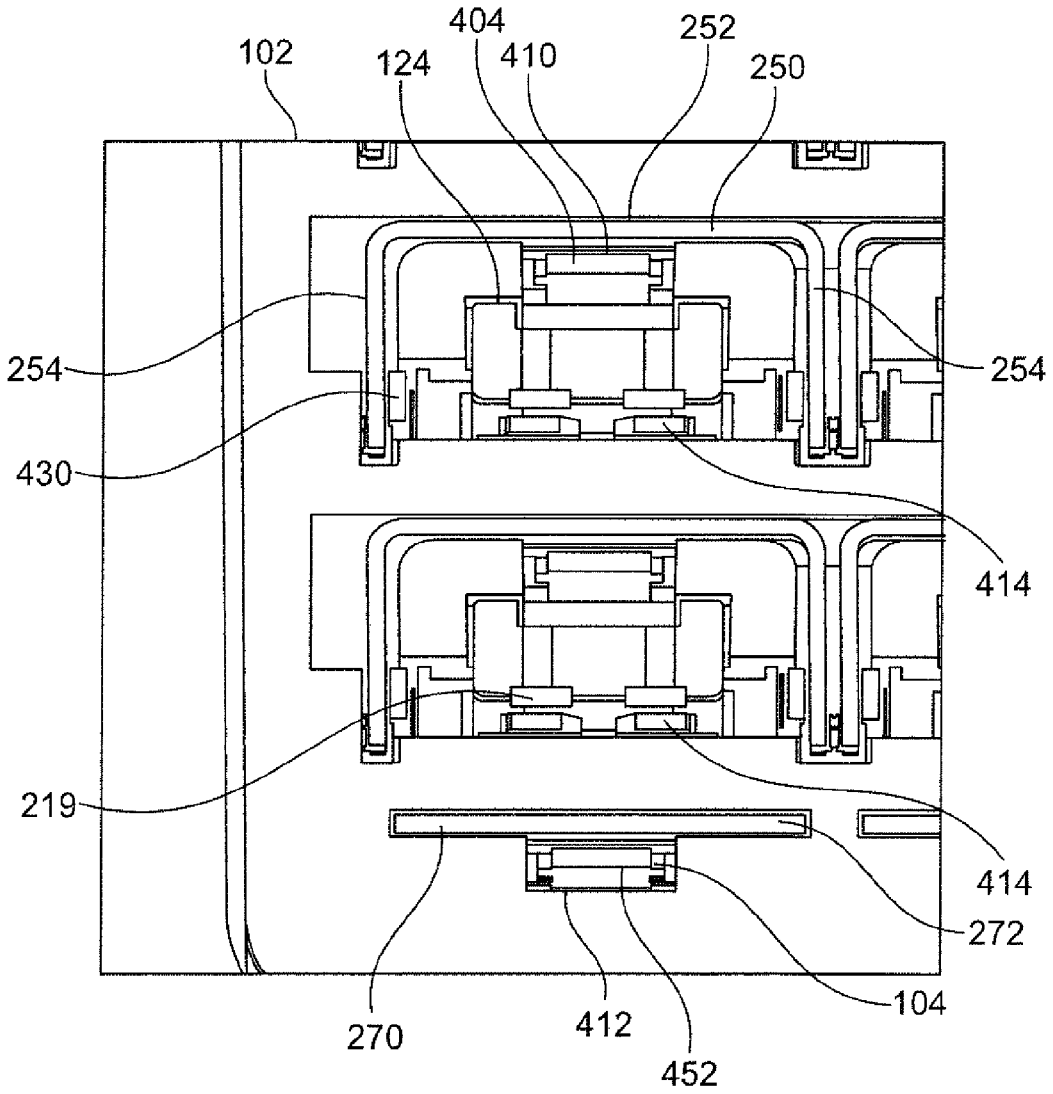
FIG. 30 illustrates a top plan internal view of a header assembly mating with a receptacle assembly, according to an embodiment of the present disclosure.

FIG. 30 illustrates a top plan internal view of the header assembly 102 mating with the receptacle assembly 104, according to an embodiment of the present disclosure. As shown, the receptacle shield ground beam 452 of the ground shield 412 contacts the main beam 272 of the ground shield 270. The contact tabs 219 of the header assembly 102 contact the signal contacts 414 of the receptacle assembly 104. The main beam 404 of the ground shield 410 contacts the main beam 252 of the ground shield 250, while the side beams 430 of the ground shield 410 contact the side beams 254 of the ground shield 250. As shown in FIG. 30, the signal connections (for example, the mating connection between the signal contacts 414 and the contact tabs 219) are bounded or otherwise surrounded by ground components.

Referring to FIGS. 1-30, embodiments of the present disclosure provide a mezzanine connector system including a header assembly that is configured to mate with a receptacle assembly. The header assembly may be formed as a unitary piece. The header assembly may include a first set of channels (for example, signal channels) configured to receive and retain signal contacts, such as signal pins retained within a dielectric carrier, and a second set of channels (for example, ground channels) that are configured to receive and retain ground shields.

Embodiments of the present disclosure provide mezzanine connector systems that provide cost effective and reliable connections between circuit boards.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A component assembly of an electrical connector system, the component assembly comprising:

a main housing defining signal channels extending through the main housing and ground channels extending into at least a first surface of the main housing, wherein each of the signal charnels has opposed first and second sides connected to opposed first and second ends at the first surface of the main housing, and wherein the plurality of ground channels include a first ground channel disposed outside of the first side, a second ground channel disposed outside of the second side, a third ground channel disposed outside of the first end, and a fourth ground channel disposed outside of the second end;

a plurality of signal modules, wherein at least a portion of each of the plurality of signal modules is retained within a respective one of the signal channels; and a plurality of ground shields, wherein at least a portion of each of the plurality of ground shields is retained within at least one of the ground channels.

2. The component assembly of claim 1, wherein the main housing is formed as a unitary piece.

3. The component assembly of claim 1, further comprising a mating shroud secured to the main housing, wherein the mating shroud is configured to receive a receptacle assembly.

4. The component assembly of claim 3, wherein the mating shroud includes one or more latch members that latchably secure to one or more reciprocal latch retainers of the main housing.

5. The component assembly of claim 3, wherein the mating shroud includes a base integrally connected to a perimeter wall extending from the base, wherein an internal chamber is defined between the base and the perimeter wall, and wherein the internal chamber configured to receive the receptacle assembly.

6. The component assembly of claim 3, wherein the main housing is formed of metal and the mating shroud is formed of plastic.

7. The component assembly of claim 1, wherein the main housing includes one or more of a conductive plastic, a molded metal, or a plastic inner body that is plated with a metal.

8. The component assembly of claim 1, wherein each of the plurality of signal modules is impedance-tunable.

9. The component assembly of claim 1, wherein the carrier comprises one or more retention protuberances extending outwardly therefrom, wherein the one or more retention protuberances securely connect the carrier to the main housing within one of the signal channels.

10. The component assembly of claim 1, wherein the carrier includes one or more shoulders configured to abut against ledges of the main housing.

11. The component assembly of claim 1, wherein at least one of the plurality of ground shields comprises a C-shaped ground shield.

12. The component assembly of claim 11, wherein the C-shaped ground shield includes a main beam connected to opposed first and second end beams, wherein the main beam resides in a first plane that is orthogonal to second and third planes in which the first and second end beams reside.

13. The component assembly of claim 1, wherein each of the plurality of ground shields comprises a resilient securing tab extending from a main beam, wherein the resilient securing tab securely latches the main beam to a portion of the component assembly.

14. The component assembly of claim 1, wherein each of the plurality of ground shields comprises at least one outwardly-extending retention protuberance that securely retains each of the plurality of ground shields in a respective one of the ground channels.

15. The component assembly of claim 1, therein at lea one of the plurality of ground shields comprises a single planar beam.

16. The component assembly of claim 1, wherein each of the plurality of ground shields is oriented in a common direction.

17. The component assembly of claim 1, further comprising a header ground contact extending from a second surface of the main housing, wherein the second surface is opposite from the first surface.

18. The component assembly of claim 1, wherein each of the plurality of signal modules is bounded by ground material throughout the component assembly.

19. A header assembly of a mezzanine connector system, the header assembly comprising:

a main housing formed as a single piece and defining signal channels extending through the main housing and ground channels extending into at least a first surface of the main housing, wherein the main housing includes one or more latch retainers, wherein each of the signal channels has opposed first and second sides connected to opposed first and second ends at the first surface of the main housing, and wherein the plurality of ground channels include a first ground channel disposed outside of the first side, a second ground channel disposed outside of the second side, a third ground channel disposed outside of the first end, and a fourth ground channel disposed outside of the second end;

a mating shroud secured to the main housing, wherein the mating shroud is configured to receive a receptacle assembly, wherein the mating shroud includes: (a) a base integrally connected to a perimeter wall extending from the base, wherein an internal chamber is defined between the base and the perimeter wall, and wherein the receptacle assembly is configured to mate to the header assembly within the internal chamber; and (b) one or more latch members that latchably secure to the one or more reciprocal latch retainers;

a plurality of signal modules, wherein at least a portion of each of the plurality of signal modules is retained within a respective one of the signal channels, wherein each of the plurality of signal modules is bounded by ground material throughout the header assembly, wherein each of the Plurality of signal modules comprises a carrier that retains header signal pins, wherein the carrier comprises one or more first retention protuberances extending outwardly therefrom, and one or more shoulders configured to abut against ledges of the main housing, wherein the one or more first retention protuberances securely connect the earner to the main housing within one of the signal channels; and a plurality of ground shields, wherein at least a portion of each of the plurality of ground shields is retained within at least one of the ground channels.

* * * * *